US012492049B2

(12) United States Patent
Iwamura et al.

(10) Patent No.: US 12,492,049 B2
(45) Date of Patent: Dec. 9, 2025

(54) ASSEMBLIES FOR DRINKING AND RELATED METHODS

(71) Applicant: Takeya USA Corporation, Costa Mesa, CA (US)

(72) Inventors: Nobuhiro Iwamura, Osaka (JP); Hiroshi Taketani, Mino (JP)

(73) Assignee: Takeya USA Corporation, Costa Mesa, CA (US)

( * ) Notice: Subject to any disclaimer, the term of this patent is extended or adjusted under 35 U.S.C. 154(b) by 0 days.

(21) Appl. No.: 18/625,549

(22) Filed: Apr. 3, 2024

(65) Prior Publication Data

US 2024/0336410 A1 Oct. 10, 2024

Related U.S. Application Data

(60) Provisional application No. 63/495,040, filed on Apr. 7, 2023.

(51) Int. Cl.
*B65D 47/24* (2006.01)
*B65D 43/02* (2006.01)

(52) U.S. Cl.
CPC ..... *B65D 47/249* (2013.01); *B65D 43/0229* (2013.01); *B65D 2543/00046* (2013.01); *B65D 2543/00092* (2013.01); *B65D 2543/00231* (2013.01); *B65D 2543/00509* (2013.01)

(58) Field of Classification Search
CPC ..... B65D 47/249; B65D 43/0229; B65D 2543/00046; B65D 2543/00092; B65D 2543/00231; B65D 2543/00509; B65D 41/28; A47G 19/2272
USPC ..... 220/715, 714, 711, 703; 215/320, 301
See application file for complete search history.

(56) References Cited

U.S. PATENT DOCUMENTS

| | | | | |
|---|---|---|---|---|
| 5,169,016 | A * | 12/1992 | Hinz, Jr. | A47G 19/2272 222/506 |
| 6,098,834 | A * | 8/2000 | Hatsumoto | A47G 19/2272 220/756 |
| 8,297,462 | B1 * | 10/2012 | Joyce | F16B 45/026 215/396 |
| 8,397,940 | B2 * | 3/2013 | Steininger | A45F 3/18 220/254.1 |
| 8,863,650 | B2 * | 10/2014 | Lin | A47J 31/20 99/287 |
| 11,447,308 | B1 * | 9/2022 | Lin | B65D 47/0857 |
| 2005/0045634 | A1 * | 3/2005 | Ward | A47G 19/2272 220/254.3 |
| 2006/0175331 | A1 * | 8/2006 | Lin | A47G 19/2272 220/254.5 |
| 2019/0210773 | A1 * | 7/2019 | Huang | B65D 47/249 |
| 2020/0391910 | A1 * | 12/2020 | Pinelli | A47G 19/2272 |
| 2021/0086963 | A1 * | 3/2021 | Siegenthaler | B65D 47/2062 |

(Continued)

*Primary Examiner* — Steven A. Reynolds
(74) *Attorney, Agent, or Firm* — Alumen IP Law PC

(57) ABSTRACT

A drinking assembly, such as a water bottle or a drinkware, having a drinking vessel and a lid assembly attached to the drinking vessel, such as by threads. The drinking vessel can have a double-wall construction. The lid assembly can have a control assembly to open and close a drink opening and a vent opening. The lid assembly can be removed from the body of the lid to enable cleaning. The control arm of the control assembly can pivot or rotate to impart an axial motion on an actuator to open the drink opening and the vent opening.

33 Claims, 9 Drawing Sheets

(56) References Cited

U.S. PATENT DOCUMENTS

| | | | | |
|---|---|---|---|---|
| 2022/0281656 | A1* | 9/2022 | Ross | B65D 43/0214 |
| 2023/0002130 | A1* | 1/2023 | Huang | A47G 19/2288 |

* cited by examiner

ASSEMBLIES FOR DRINKING AND RELATED METHODS

CROSS-REFERENCED TO RELATED APPLICATION

This is a regular utility application of U.S. Provisional Application No. 63/495,040, filed Apr. 7, 2023, the contents of which are expressly incorporated herein by reference.

FIELD OF ART

The present disclosure generally relates to assemblies for drinking with specific discussions on assemblies having a lid and a container vessel and related methods.

BACKGROUND

Drinking containers are well known for a variety of situations for hydrating, such as for office use, for hiking, and for playing physical sports. Drinking containers come in a variety of types, typically with a lid and a base or drinking vessel. The lid and the base can typically attach by threads or by snap fitting. The base can be made from plastic or from metal, and can be double walled for insulation. The lid can have a drink opening to allow fluids inside the base to dispense for drinking. The drinking opening can open and close using a simple threaded cap or with an actuator.

SUMMARY

A drinking assembly having a drinking vessel and a lid assembly attached to the drinking vessel, such as by threads, is disclosed. The drinking vessel can have a double-wall construction. The lid assembly can have a control assembly to open and close a drink opening and a vent opening. The lid assembly can be removed from the body of the lid to enable cleaning. The control arm of the control assembly can pivot or rotate to impart an axial motion on an actuator to open the drink opening and the vent opening.

Aspects of the invention further include an assembly for drinking, said assembly comprising: a drinking vessel comprising a body having a central vertical axis, a threaded open top, and a closed bottom; a lid assembly threaded to the threaded open top of the drinking vessel, said lid assembly comprising: a lid top having surface with a cutout defining a lid channel having a channel floor and wherein the lid top is surrounded on an outer periphery by a primary rim section having a cut-out; a control arm pivotably mounted in the lid channel of the lid top, the control arm having a rim piece occupying the cut-out of the primary rim section and forming a rim portion at the control arm, a slider controller located within two side edges of the control arm, the slider controller movable between a first position to lock pivotable motion of the control arm and movable to a second position to unlock pivotable motion of the control arm; a clearance gap between a bottom of the control arm and a lid flange, the lid flange located below, elevation-wise, the surface of the lid top; a well having a well surface with a drink opening and wherein the well surface is located below, elevation-wise, the surface of the lid top; an actuator for opening and closing the drink opening, the actuator comprising a seal post having a drink opening seal mounted thereon and pressing against an opening seat in a seal closed position to close the drink opening, a primary post spaced from the seal post and projecting through a bore of a post support on the channel floor, and a bridge connecting the seal post and the primary post; a return spring mounted around the post support and biasing against the channel floor and a retaining cap that is removably attached to the primary post; wherein said return spring is in a first compressed state and biases the drink opening seal against the opening seat in the seal closed position when the control arm is in a rest position and not acted on by an external pivotable force; and wherein said return spring is in a second compressed state when the control arm is pivoted by an external force to a pivoted position to move the primary post generally parallel to the central vertical axis, which moves the seal post generally parallel to the central vertical axis to move the drink opening seal away from the opening seat to open the drinking opening.

A still further aspect of the invention includes an assembly for drinking, said assembly comprising: a drinking vessel comprising a body having a central vertical axis, a threaded open top, and a closed bottom; a lid assembly threaded to the threaded open top of the drinking vessel, said lid assembly comprising: a lid top having surface with a cutout defining a lid channel having a channel floor and wherein the lid top is surrounded on an outer periphery by a primary rim section having a cut-out; a control arm pivotably mounted in the lid channel of the lid top, the control arm having a rim piece occupying the cut-out of the primary rim section and forming a rim portion that forms a ring with the primary rim section, a slider controller located within two side edges of the control arm, the slider controller movable between a first position to lock pivotable motion of the control arm and movable to a second position to unlock pivotable motion of the control arm; a well having a well surface with a drink opening and an embankment; an actuator for opening and closing the drink opening, the actuator comprising a seal post having a drink opening seal mounted thereon and pressing against an opening seat in a seal closed position to close the drink opening, a primary post spaced from the seal post and projecting through a bore of a post support on the channel floor, and a bridge connecting the seal post and the primary post; and a return spring mounted around the post support and biasing against the channel floor and a retaining cap that is removably attached to the primary post.

The invention further includes a method of using an assembly for drinking. The assembly for drinking comprising: a drinking vessel comprising a body having a central vertical axis, a threaded open top, and a closed bottom and said lid assembly comprising; a lid assembly threaded to the threaded open top of the drinking vessel, said lid assembly comprising: a lid top having surface with a cutout defining a lid channel having a channel floor and wherein the lid top is surrounded on an outer periphery by a primary rim section having a cut-out; a control arm pivotably mounted in the lid channel of the lid top, the control arm having a pull tab and a rim piece occupying the cut-out of the primary rim section and forming a rim portion at the control arm, a slider controller located within two side edges of the control arm; a well having a well surface with a drink opening and wherein the well surface is located below, elevation-wise, the surface of the lid top; an actuator for opening and closing the drink opening, the actuator comprising a seal post having a drink opening seal mounted thereon and pressing against an opening seat in a seal closed position to close the drink opening, a primary post spaced from the seal post and projecting through a bore of a post support on the channel floor, and a bridge connecting the seal post and the primary post; a return spring mounted around the post support and biasing against the channel floor and a retaining cap that is removably attached to the primary post. Wherein the method comprises the steps: pushing down on the pull tab to rotate the control arm about a pivoting axis; generating a downward force on the primary post with the control arm to move the primary post along a linear path parallel to the central vertical axis; and moving the seal post downwardly away from the opening seat with the bridge connected to the primary post to open the drink opening.

A yet further aspect of the invention includes an assembly for drinking comprising a drinking vessel and a lid assembly, which can attach to one another using threads. The lid assembly has a lid body, a control assembly, and an actuator. The control assembly and the actuator are attachable to the lid body when using the assembly for drinking and removable from the lid body for cleaning.

The lid assembly is pivotable about a pivot axis. The lid assembly can be assembled from a slider controller, a control arm, and a slider follower. The slider controller can change the lid assembly from a locked state to an unlocked state. The control arm can pivot to axially move an actuator. The actuator can include a primary post and a sealing post connected to one another by a post. The primary post can move along an axis defined by a bore of a post support, which functions as a sleeve.

A return spring can be utilized to return the primary post to a closed position to close a post seal against a vent opening.

An assembly for drinking comprising a lid assembly threaded attached to a container vessel, wherein the lid assembly comprises: a lid top having surface with a cutout defining a lid channel having a channel floor and wherein the lid top is surrounded on an outer periphery by a primary rim section having a cut-out and a drinking open; a control assembly positioned in the lid channel and pivotable about a pivoting axis, said control assembly comprising a slider controller slidably positioned on an upper surface of a control arm and a slider follower positioned below a lower surface of the control arm; an actuator comprising a primary post in abutting contact with the control arm of the control assembly and a seal post having a drink opening seal pressed against an opening seat by a return spring to seal the drink opening; wherein the slider controller is mechanically attached to the slider follower and movement of the slider controller directly moves the slider follower.

Methods of making and of using drink assemblies and components thereof, such as lid assemblies, are within the scope of the present invention.

These and other features are detailed in the detailed description and represented in the attached drawing figures.

BRIEF DESCRIPTION OF THE DRAWINGS

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of assemblies for drinking or drinking assemblies provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Descriptions of technical features or aspects of an exemplary configuration of the disclosure should typically be considered as available and applicable to other similar features or aspects in another exemplary configuration of the disclosure. Accordingly, technical features described herein according to one exemplary configuration of the disclosure may be applicable to other exemplary configurations of the disclosure, and thus duplicative descriptions may be omitted herein.

Figure 1:
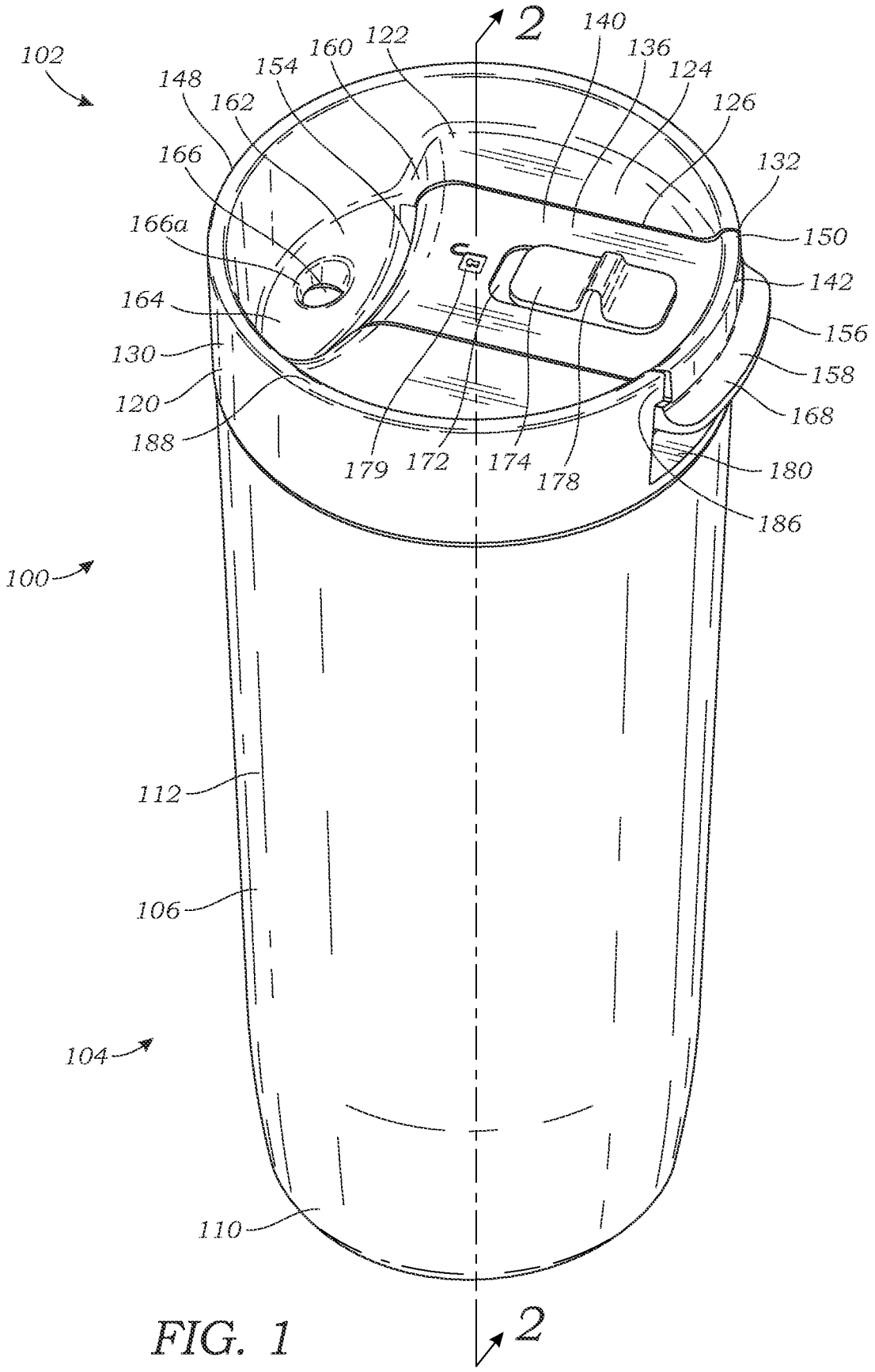
FIG. 1 is a schematic top perspective view of a drink assembly provided in accordance with aspects of the invention.

With reference now to FIG. 1, an assembly for drinking is shown, which is generally designated 100. The assembly for drinking may also be referred to as a drinking container or a drinking assembly. The assembly for drinking 100 has a lid assembly 102, or lid for short, and a container vessel or base 104. The lid and the base can be threaded together in the assembled configuration shown, in any male to female threaded configuration.

The drinking vessel or base 104 comprises a body 106 having an open top 108 and an enclosed bottom 110. The base 104 can have a variety of straight and curved combinations to define the outer contour or container silhouette 112, including any number of traditional sizes, such as 12 ounces, 16 ounces, 20 ounces, 32 ounces, etc. In an example, the base is a double-walled construction having a gap in between, which is preferably under a vacuum to improve insulation. However, a single wall construction is contemplated. The open top 108 can have female threads for threaded engagement with male threads formed on the skirt 147 (FIG. 2) of the lid 102, as further discussed below. The body 106 can have a central vertical axis. The base can be made from a durable stainless steel material or a plastic material. If plastic, the base can have an insulation layer, such as foam, between the inner and outer walls.

The lid 102 can have a body 120 with a lid top 122 having surface 124 with a lid cutout 126 defining a lid channel having a channel floor 128 and two channel sidewalls and wherein the lid top 122 is surrounded on an outer periphery by a primary rim section 130 having a rim cut-out 132 defining a gap at the primary rim section. In an example, the primary rim section spans about 310 degrees to about 360 degrees of a circle and the cutout accounts for about 20 to 70 degrees of the circle. The gap at the rim cut-out 132 can be selected to accommodate a triggering mechanism or control assembly to operate the lid, as further discussed below. The surface 124 of the lid top 122 is lower, elevationwise, than the upper edge of the primary rim section 130.

A control arm 136 can be pivotably mounted in the lid channel 126 of the lid top 122, which has two channel sidewalls and a channel floor. The control arm 136 can function as a triggering mechanism to operate the lid. For example, a user can manipulate the control arm 136 to open and close the drink opening of the lid for dispensing fluid from the interior of the base or drinking vessel 104 out through the drink opening. As further discussed below, the control arm 136 can cooperate with an actuator and the actuator can include structures that physically open and close the drinking opening.

The control arm 136 can have a body 140 having a surface with length and a width and the body occupies at least part of the lid channel 126. The control arm further includes a rim piece 142 extending vertically from the surface of the body to occupy the rim cut-out and forming a rim portion at the control arm 136. The primary rim section 130 and the rim piece 142 together forming an overall rim 148 of the lid 102. The rim 148 is generally ring shape and has at least two slits or slots 150 separating the rim piece and the primary rim section. The slots allow the rim section to move relative to the primary rim section, when the control arm moves.

In an example, the control arm 136 has two side edges 152*a*, 152*b* (FIG. 4B) that define a width of the body 140. The control arm 136 has a curved end 154 and an operating end 156 having a push tab 158, or pull tab depending on the perspective of the action. The curved end 154 forms part of an embankment 160 of a well 162, which has a well surface 164 with a drink opening 166. The push tab 158 has a structure that resembles a fin or flange 168 extending radially away from the central vertical axis of the container 104. The flange 168 has an inner edge that connects to the rim piece 142 and has a curvature that matches the curvature of the overall rim 148. The push tab 158 can extend a few centimeters radially, such as 0.5 to 1.5 cm, and has an outer edge or remote edge, which can have the same curvature as the inner edge or a different curvature.

The body 140 of the control arm 136 has a thickness. A recess 172 can be provided on the body 140, inwardly of the two side edges 152*a*, 152*b* and inwardly of the curved end 154 and the rim piece 142. The recess 172 can have a generally rectangular shape with rounded corners. The recess 172 can be sized to accommodate a slider controller 174, which is movable between a first position within the recess to a second position within the recess. In an example, the first position can be considered a lock position to lock pivotable motion of the control arm 136 and the second position can be considered an unlock position to allow pivotable motion of the control arm. As further discussed below, the slider controller 174 can incorporate structures or features to generate a physical barrier or stop to prevent pivotal movement of the control arm and that can be movable to an unobstructed position to permit pivotal movement.

The slider controller 174 can have a generally flat body with a generally flat upper surface and a generally flat lower surface having a thickness therebetween. The thickness of the slider controller 174 can have approximately the same thickness as the depth of the recess 172 so that the upper surface of the slider controller is flushed or flat with the upper surface of the body of the control arm 136 when mounted at the recess. However, the upper surface of the slider controller 174 can rise above the upper surface of the control. The recess 172, which has two lengthwise edges, can help guide the slider controller 174 as the slider controller moves between a first position and a second position.

The flat lower surface of the slider controller 174 can slide against the flat surface of the recess 172. To facilitate sliding the slider controller 174 between the first and second positions to lock and unlock the control arm, a tab 178 can extend upwardly to the upper surface to form a leverage point or leverage tab for use by the user to slide the slider controller. For example, the leverage tab 178 can slide in the direction away from the central vertical axis of the container vessel to lock the control arm 136 and in the direction of the central vertical axis to unlock the control arm. Obviously, the orientation of the locked and unlocked positions can reverse by reversing structures that allow and prevent pivotable motion of the control arm. In an example, one or more indicators 179, such as a symbol of a lock in a locked or unlocked position, can be provided on the surface of the body 140 to provide a guide or reference point for the user in moving the slider controller.

Figure 2:
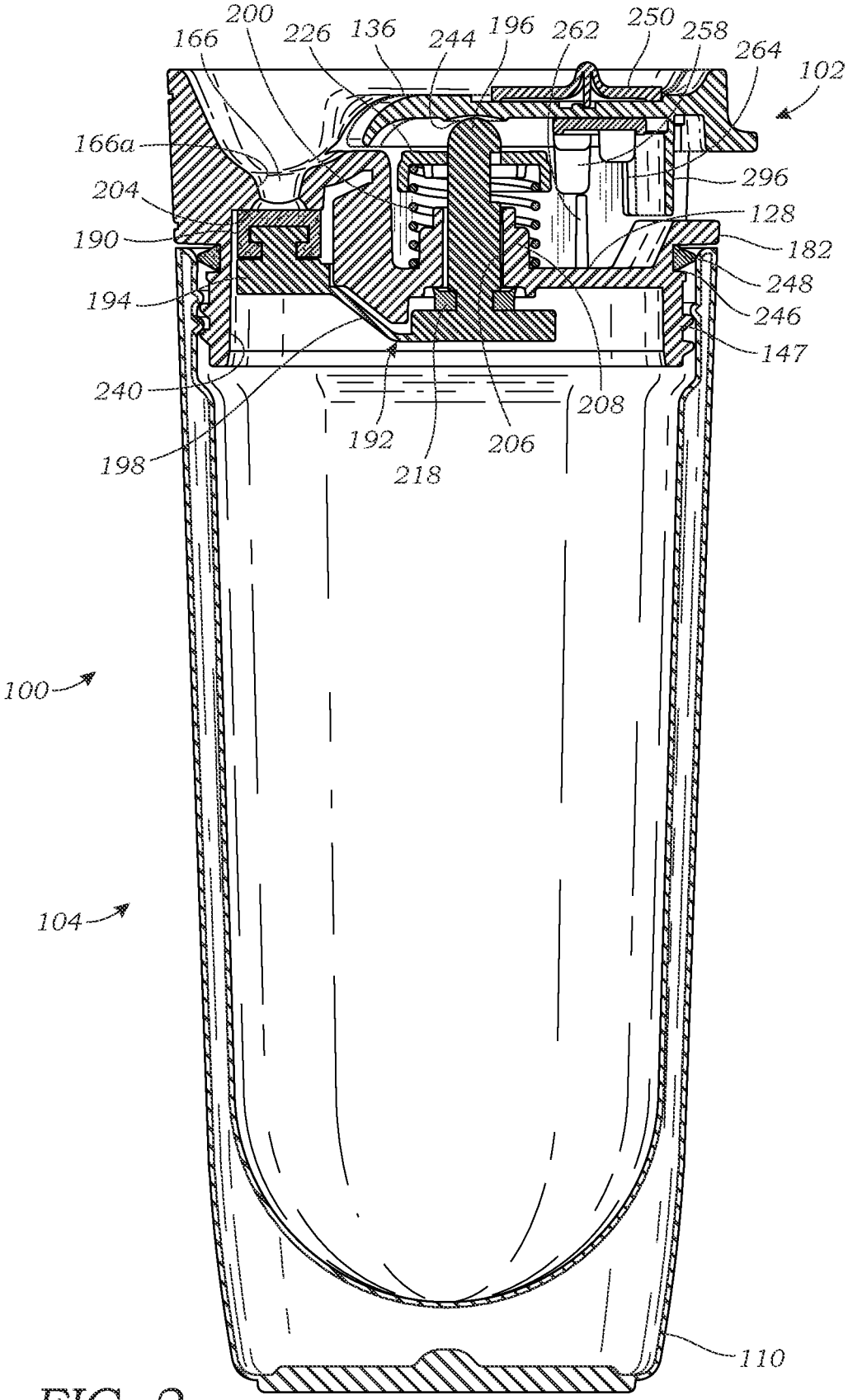
FIG. 2 is a cross-sectional side view of the drink assembly of FIG. 1.
Figure 3:
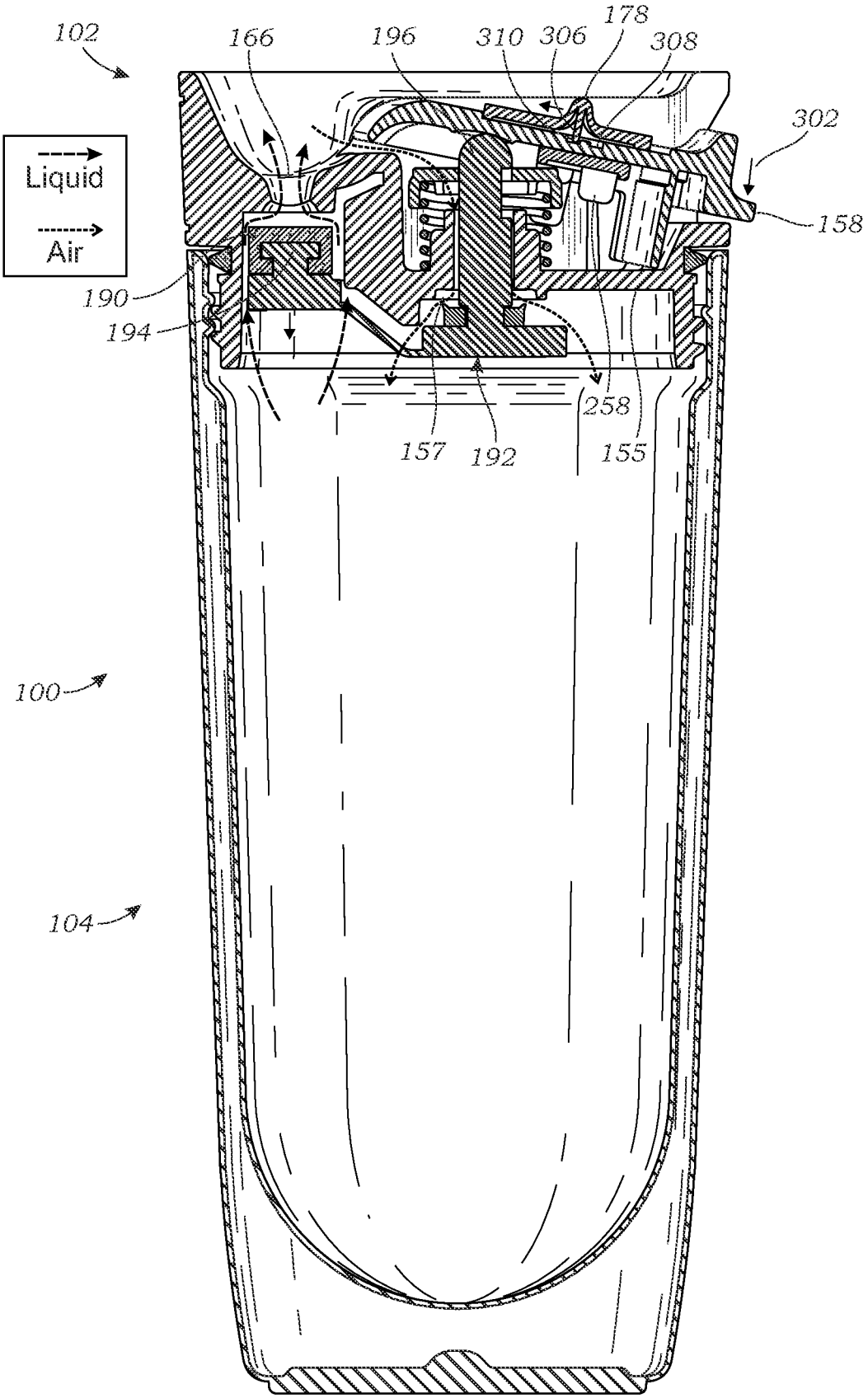
FIG. 3 is a cross-sectional side view of the drink assembly of FIG. 1, with the control arm in a pivoted position.

In an example, a clearance gap 180 can be provided between the bottom of the control arm 136 and the upper surface of the lid flange 182 (FIG. 2). The clearance gap 180 provides space or clearance for the control arm 136 to pivot from a rest position shown in FIG. 2 to a downward angular position and not restrained by the surface of the lid flange 182, as shown in FIG. 3.

In an example the cut-out 132 at the primary rim section 130 can have two vertical edges and the vertical edges define a width of the rim gap. In the example shown, a rim tab or an extended tab 186 can extend from an upper edge 188 of one or both vertical edges of the rim cut-out 132 to reduce the effective width of the rim gap at the upper edge 188. The gap is therefore wider below the one or two extended tabs 186 and narrower at the extended tab or tabs. This configuration allows for clearance below the extended tab or tabs in case the control arm shifts side-to-side as it pivots downward. However, the rim cut-out can be practiced without any extended tab 186.

The well 162 on the lid is bounded by the primary rim section 136 and an embankment 160. The well 162 has a shape that resembles a prolate spheroid, which is similar to a football. The drink opening 166 can be located approximately centrally at the well bottom surface 164. The drink opening is shown having an oval shape but can embody other shapes, such as round, elliptical, prolate spheroid, and irregular. The drink opening sidewall 166*a* can be vertical or tapered relative to the central vertical axis. One or more projections can be provided on the sidewall 166*a* to facilitate mixing or turbulence as fluids flow out past the surface of the sidewall.

With reference now to FIG. 2, a cross-sectional side view of the assembly for drinking 100 of FIG. 1 is shown. The cross-sectional view shows the assembly 100 in the closed position, in which the drink opening is closed by a drink opening seal 190 and the control arm 136 is in a rest position, which is understood to mean a position in which no external force is applied to the control arm by a user. The control arm 136 can be moved to the rest position by an actuator 192, which has a return spring. As shown, the actuator 192 has a seal post 194 having the drink opening seal 190 located thereon and a primary post 196. In an example, the seal post 194 is located at one end of a bridge 198 and the primary post 196 is located on an opposite end of the bridge. The bridge connects the two posts and the actuator can be unitarily formed. In an example, the actuator 192 is unitarily formed from a plastic material. In alternative embodiment, the actuator 192 is made from a metal material, such as stainless steel material.

Both the seal post and the primary post can be biased upwardly away from the drinking vessel bottom 110 by a return spring 200. The return spring 200 can be a helical compression spring configured to keep two ends of the spring from coming together, as further discussed below. The seal post 194 has a shaft and an end flange, which together define an overall height. The opening seal 190, which can be made from an elastomer or a silicone material, can have a body with a reduced opening for snap fitting around the end flange of the seal post 194 and form fit with the reduced area of the shaft, which can be considered a neck, located between the end flange and the bridge. The drink opening seal 190 can have a flat upper surface as shown for pressing against a drink opening seat 204 to seal the drink opening 166 from fluid flow thereacross. In other examples, the opening seal 190 can have a dome shape upper surface for sealing against the drink opening seat 204.

In another example, the interior of the dome shaped upper surface of the drink opening seal 190 and the end flange of the seal post 194, when assembled, define a hollow space. The dome shaped upper surface of the opening seal can compress against the drink opening seat 204 and the hollow space can reduce due to the compression.

The primary post 196 is spaced from the seal post 194 and projects through a bore 206 of a post support 208 located on the channel floor 128. The bore 206 of the post support 208 has a first opening at the channel floor 128 and a second opening at the opposite end of the post support to define a through bore. The bore 206 has an internal surface that is generally constant, such as having a single inside diameter, to define a sleeve for guiding translational movement of the primary post 196, generally parallel to the vertical central axis of the drinking vessel 104.

The entrance at the first or lower opening of the bore 206 can be flared or radiused to reduce sharp corners and/or to facilitate assembly of the primary post 196 when inserting the primary post from the lid bottom to install the actuator, as further discussed below. Exteriorly, the post support 208 can have a constant exterior surface defining a single outside diameter (OD) structure. In other examples, the post support 208 can have a first outside diameter section and a different second outside diameter section. The upper end of the post support 208 can have a smaller OD compared to a lower section of the post support to facilitate placement of the return spring 200 over the post support 208. The second outside diameter section can be a solid cylindrical section. Alternatively, the post support can have a single diameter cylinder and the second outside diameter section is formed by providing spaced apart fins or ribs around the single diameter cylinder, which together define a larger lower OD section of the support post. The post support 208 can be located at the geometric center of the lid or can be off-center depending on the geometries of the other lid components, such as the lid opening and the size of the actuator 192. As shown, the center of the post support 208 is off-centered relative to the geometric center of the lid.

Figure 4A:
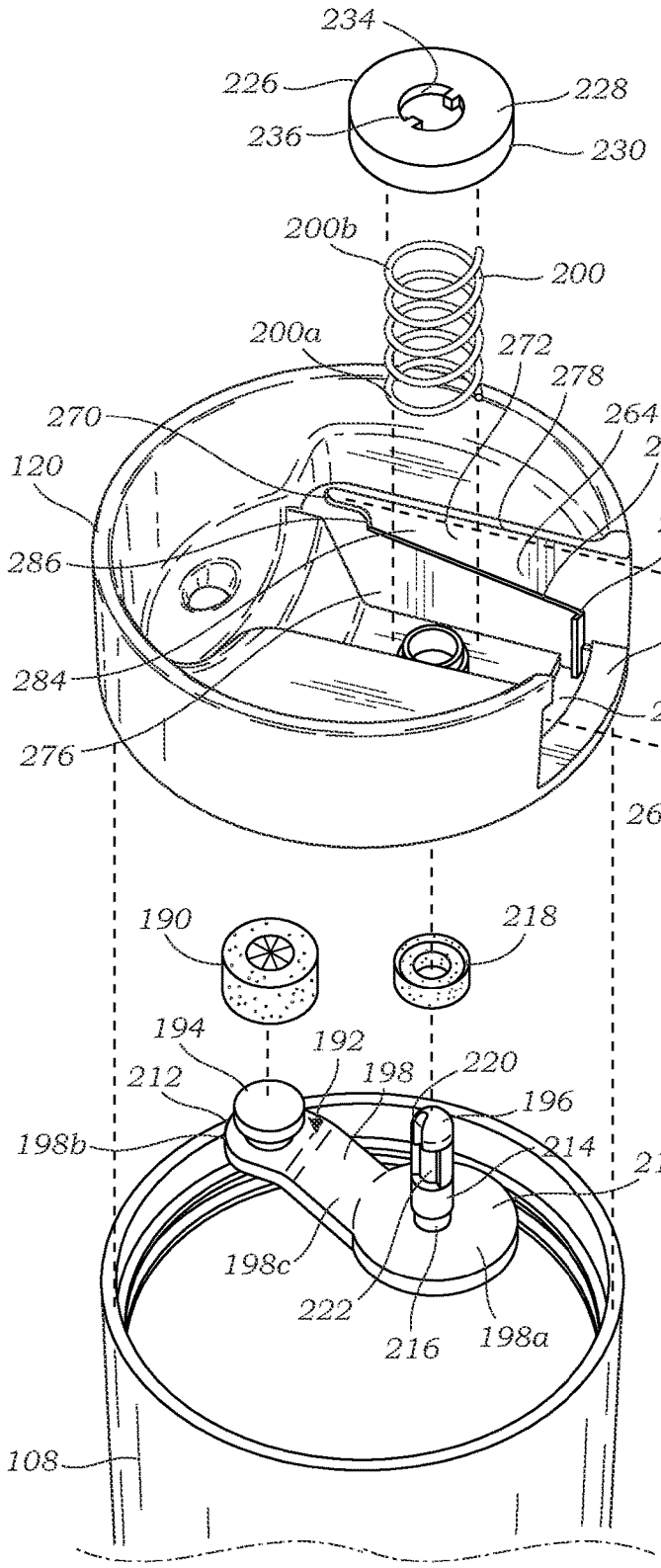
FIG. 4A is an exploded perspective view of the lid assembly and part of the drink vessel of FIG. 1.

With further reference to FIG. 4A in addition to FIG. 2, the actuator 192 incorporates a bridge 198 to connect the seal post 194 and the primary post 196. In an example, the bridge 198 comprises a first end 198*a*, a second end 198*b*, and a connecting portion 198*c* between the two ends. The first end 198*a* can have a disc-shape contour with a generally planar surface 210 having the primary post 196 extending vertically thereof. The connecting portion 198*c*, or central portion of the bridge, extends from the first end 198*a* towards the second end 198*b*. In the example shown, the second end 198*b* is rounded from the width of the connecting portion to define a rounded second end 198*b*. The second end 198*b* can have a planar surface 212 and wherein the planar surface 212 at the second end and the planar surface 210 at the first end 198*a* are on two different elevations or planes. Preferably, the planar surface 210 at the first end 198*a* is lower, elevation-wise, then the planar surface 212 at the second end 198*b*. When the two planar surfaces are on different planes, the connecting portion 198*c* is angled to connect the two different planes. Further, because the two planar surfaces are on different planes, the connecting bridge has at least two changes in direction, where the central bridge section transitions to the two planar sections.

The primary post 196 has a first outside diameter section 214 and a second outside diameter section 216 that is smaller than the first outside diameter section to form a recessed section of the post, forming an undercut section of the primary post. This allows the post gasket 218, which has an inside opening smaller than the first outside diameter section 214 of the primary post, to be installed onto the primary post at the recessed section, as shown in FIG. 2. The post gasket 218 is configured to seal the bottom opening of the bore 206 where the primary post 196 projects into the channel floor of the lid.

The primary post 196 has two channels 220. In the example shown, the two channels are diametrically positioned on the shaft of the primary post and are generally vertical and parallel to the axis of the primary post. Each channel 220 can originate at the rounded remote end of the primary post and extends into a respective undercut section 222, which is located above the second outside diameter section 216 of the primary post. The two opposing channels 220 and the two undercut sections 222 define a latch connection on the primary post for latching with the securement cap 226, as further discussed below.

With reference again to FIG. 2, the return spring 200 has a first end 200*a* and a second end 200*b* (FIG. 4A) and is held compressed between the channel floor 128 and the retaining cap 228. The retaining cap 226 is in turn removably secured to the primary post 196. Thus, when the actuator 192 moves up and down and the primary post moves up and down, or axially translates, the return spring moves between a first compressed state, when the container is in a closed position, to a second compressed state, when the drink opening is opened. As the channel floor 128 is fixed or stationary, the first end of the spring stays stationary while the second end of the spring moves towards the first end when the spring is further compressed. The retaining cap 226 has a planar wall 228 with a skirt 230, defining a receiving space on the underside for capturing the second end 200*b* of the return spring 200, as shown in FIG. 2.

Interiorly, the retaining cap 226 comprises an inside or central opening 234 having a perimeter located inwardly of the outside perimeter of the planar wall 228. One or more tabs 236 extend outwardly from the perimeter of the central opening 234. As shown, two tabs 236 are provided at the central opening, which can be diametrically opposed. The retaining cap 226 can be secured to the primary post 196 by first projecting the primary post into the lower opening of the bore 206 of the post support 208 and then aligning the combination drink opening seal 190 and seal post 194 into the dispensing cavity 240 (FIG. 2) of the lid to seal against the opening seat 204.

The return spring 200 is then placed over the post support 208. The retaining cap 226 is then placed over the primary post 196 by aligning the two tabs 236, 236 on the retaining cap with the two channels 220, 220 on the primary post and then pressing down on the return spring 200 with the planar wall of the retaining cap until the two tabs 236, 236 can be rotated into the undercut sections 222, 222 of the primary post. The spring force of the return spring 200 can force the tabs against the undercut sections to make uncoupling between the retaining cap and the primary post difficult. In some examples, the undercut sections 222, 222 can include notches or grooves to retain the tabs 236, 236 and increase the difficulty of separating the two.

Once the retaining cap 226 is coupled to the primary post 196 with the return spring 200 held against the retaining cap and the channel floor 128, the spring biases outwardly against the channel floor and the retaining cap in a first compressed state. As the channel floor 128 is stationary, the return spring 200 will push up against the retaining cap 226, which pushes up on the primary post. The primary post moves upwardly due to the spring bias until the post gasket 218 is pressed against the surface surrounding the bottom opening of the bore 206 of the channel floor to seal the lower opening of the bore. At the same time, upward movement of the primary post 196 moves the bridge 198 upwardly, which moves the seal post 194 upwardly, which then moves the drink opening seal 190 upwardly to seal against the opening seat 204. The primary post also pushes up on the rounded bearing surface 244 on the underside surface of the control arm 136 to move the control arm to the rest position, when no external force is applied to the control arm. The operation of the actuator 192 to open the drink opening 166 is further discussed below, which requires compressing the spring 200 to a second compressed state.

In some examples, the actuator 192 and/or components mounted to the actuator can be sized and shaped to provide air venting prior opening drinking opening 166 for dispensing fluid. That is, the post gasket 218 can be configured to separate from the lower surface 155 of the lid when the primary post is actuated, such as pushed downwardly, by the control arm 136 prior to the drink opening seal 190 separating from the opening seat 204. This serial opening allows air pressure inside the drink assembly 100 to vent out the path defined by the bore 206 before the drink opening opens for dispensing fluid from inside the base. At that point, air vents into the container vessel to compensate for fluid dispensed out the drink opening.

In an example, the serial opening is carried out by the post gasket 218 separating from the lower surface 155, and then relying on the dome of the drink opening seal 190 to maintain its seal against the drink opening seat 204 as the actuator 192 moves downwardly by the control arm 136. As the actuator moves downwardly, the dome shape of the drink opening seal 190 continues to recover and expands from its compressed state. Then as the actuator continues to move downwardly by the control arm and the drink opening seal recovers its normal dome shape or nearly recovers its normal dome shape, the seal against the drink opening seat 204 with terminate. At that point, liquid from the container vessel can dispense out the drink opening.

In another example, serial opening of the post gasket 218 and the drink opening seal 190 can be practiced by providing an independently movable seal post 194 and/or drink opening seal 190. For example, when the primary post 196 is pushed downwardly by the control arm, a second helical spring with a lower spring constant then the spring constant of the return spring can continue to bias the drink opening seal 190 against the drink opening seat 204. As the primary post moves axially downwardly by the pivoting motion of the control arm, the second spring fully expands to maintain the seal between the drink opening seal and the drink opening seat. Then as the primary post moves to its maximum downward position and the second spring fully expanded, the movement will cause the drink opening seal to separate from the drink opening seat.

Returning again to FIG. 2, a groove 246 located above the threaded skirt 147 and under the lid flange 182 can be provided to hold a sealing ring 248. The sealing ring 248 can be an O-ring or a gasket. The sealing ring allows a fluid tight seal to be formed when the upper edge of the drinking vessel 104 presses the sealing ring 248 against the lid flange 128 and compressing the sealing ring therebetween.

Figure 4B:
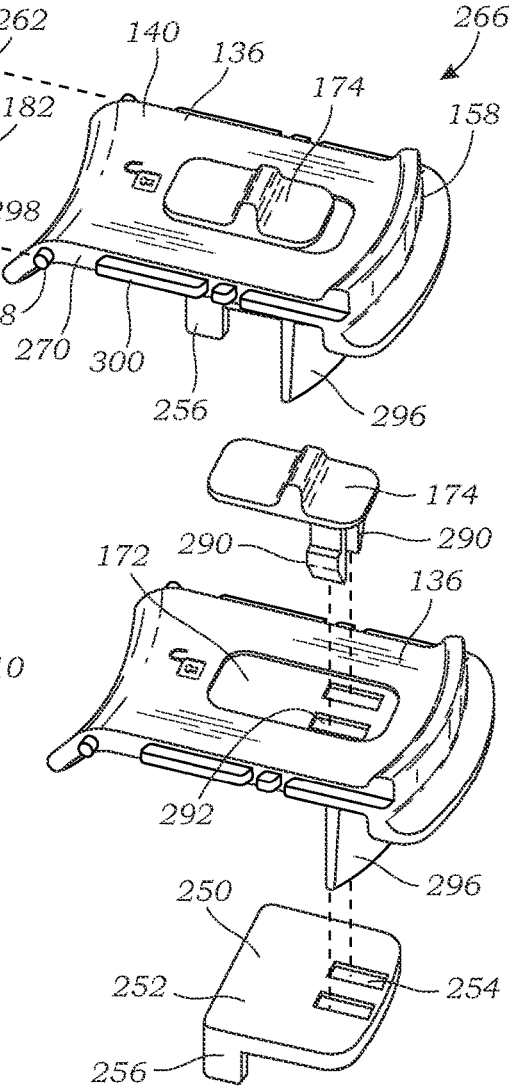
FIG. 4B is an exploded perspective view of the control assembly of FIG. 4A, showing a slider controller, a control arm, a slider follower.

With reference now to FIGS. 4A and 4B and with continued reference to FIG. 2, the slider controller 174 can be used to lock and unlock the control arm 136, as previously discussed. In an example, the slider controller 174 cooperates with a slider follower 250, which is located at the underside surface of the control arm 136. As shown in FIG. 4B, the slider follower 250 has a planar wall surface 252 with two side edges and having one or more retention slots 254, with two shown. Two reinforcing fins 256 (only one shown) can be provided along two corners of the planar wall 252. Inwardly of the two fins, two slider blocking tabs 258 (FIG. 2) can be provided. The two slider blocking tabs 258 can each have a length that is longer than the two fins 256, as viewed from how far they extend below the lower surface of the slider follower 250.

The longer length of the two slider blocking tabs 258 allow them to interact with respective blocking walls 262 located on the channel walls or sidewalls 264 of the lid channel 126. For example, the slider controller 174 can slide to the first position or locked position, which then moves the slider follower 250 to the first position, which then positions the two slider blocking tabs 258 directly over the two respective blocking walls 262, 262, one on each of the channel sidewall, to block downward movement of the slider blocking tabs 258 of the slider follower 250. As the slider follower 250 is connected to the control arm 136, the control arm is also blocked from downward movement by the blocking walls 262, 262 since the slider blocking tabs are also blocked by the blocking walls. The control arm 136 can pivot by moving the slider blocking tabs 258 away from the blocking walls. In some examples, the reinforcing fins 256 can serve as both the reinforcing element for the wall of the slider follower and as the slider blocking tabs. Thus, the pair of slider blocking tabs may be omitted in the alternative embodiment if the reinforcing fins are extended and positioned to interact with the blocking walls.

When the slider controller 174 moves to the second position, or unlocked position, the slider blocking tabs 258 move away from the blocking walls 262 and no longer obstructed by the blocking walls. When no longer blocked, downward movement of the blocking tabs 258 is now possible. As the slider follower 250 is connected to the control arm 136, this in turn allows the control arm to pivot downwardly, as further discussed below.

The control assembly 266 for controlling the operation of the drinking assembly 100 comprises the control arm 136, the slider controller 147, and the slider follower 250. The control assembly 266 can be removed from the body 120 of the lid 102 for cleaning. When the control assembly 266 is separated from the body of the lid, the actuator 192 can also be removed by first separating the retaining cap 226 from the primary post 196 to allow the primary post to slide downwardly out of the post support 208.

In an example, two pivot pins 268 (only one shown) are provided, one each, on each of the two side edges 270 of the of the body 140 of the control arm 136. The pins 268 are located near the curved end 154 of the body 140 of the control arm, away from the pull tab or push tab 158. The pins 268 are configured to cooperate with the retaining slots 270 of the two channel sidewalls 264 (only one shown), as further discussed below. The two aligned pivots define a pivoting axis of the control arm and the control assembly.

Each of the two channel walls or sidewalls 264 comprises a recessed wall section 272. The recessed wall section 272 is recessed from the outward most wall surface 276 of each channel sidewall 264. The recessed wall section 272 has a shape that is sized and shaped to allow the control arm 136 to be retained therein and pivot. As shown, the recessed wall section 272 has an upper edge 278, a lower edge 280, and a retaining slot 270 at the end of the two edges 278, 280. Each edge comprises a surface or lip, which can range from about 2 mm to 5 mm and defines the depth of the recessed wall section 272. In the example shown, the upper edge 278 is generally straight, or orthogonal to the central vertical axis of the drinking vessel, which can be considered a zero angular coordinate. The lower edge 280 is also generally straight and is oriented about 10 degrees to about 40 degrees from the zero angular coordinate of the upper edge 278. This angular range between the two edges 278, 280 define a working pivot range 284 of the control arm 136. Said differently, the control arm can move between the pivot range 284, as further discussed below.

In an example, the lower edge 280 is linear or straight from a first end to a second end of the lower edge. The second end can be considered the end that meets the retaining slot 270 with the upper edge 278. Alternatively, as shown, the lower edge 280 is not linear and comprises a curved edge section 286 that changes the direction of the lower edge. The curved edge section 286 is incorporated to allow the angle of the working pivot range 284 to be selected while also allowing the distance between the first end of the upper and lower edges and the retaining slot 270 at the second end to be shortened.

The lower edge 280 near the retaining slot 270 and/or the upper edge 278 near the retaining slot may incorporate a bump, a narrowed section, or reduced section to create a socket at the retaining slot 270. The socket at the retaining slot on each channel sidewall allows the pins of the control assembly 266 to be installed to the body of the lid and remain there until a removal force is applied to overcome the grip of the sockets to remove the control assembly, such as for cleaning.

In an example, the control assembly 266 is made from three separable components that include the slider controller 174, the control arm 136, and the slider follower 250, as previously discussed. The slider controller can be located within the recess 172 of the control arm 136 and the two latching fingers 290 extending from the slider controller can extend through the receiving slots 292 in the recess of the control arm 136 to latch with the retention slots 254 on the slider follower 250. More broadly, the slider controller can mechanically attach to the slider follower. The mechanical attachment can be a latching mechanism. The latching fingers 290 can have detents or barbs to latch against the opening perimeters of the two retention slots. The latching can unlatch by squeezing the two latching fingers 290 together to free the detents from the opening perimeters and then reversing the action. Removal of the various components allow the various components to be separately cleaned or washed. Thus, through the mechanical connection, movement of the slider controller can directly move the slider follower, despite the slider controller being located on an upper surface of the control arm and the slider follower being located on a lower surface of the control arm.7

As the slider controller 174 can slide between a first position and a second position within the recess to lock and unlock the pivoting motion of the control arm 136, the two receiving slots 292 on the control arm 136 are larger than the widths of the latching fingers 290 to enable translation of the latching fingers within the receiving slots 292 to move the slider controller 174 between the two positions. The latching between the latching fingers 290 and the retention slots 254 should be solid with little or no slack between them.

A partition wall or partition tab 296 can extend from the lower surface of the control arm 136. The partition wall 296 has a width that is approximately the same width as the body 140 of the control arm and a height or length. The partition wall 296 can be planar or flat or can have a slight curvature that resembles the curvature of the rim. In the control assembly 266 installed position of FIG. 2, the partition wall 296 shields the space in the lid channel 126 from view when looking under the push tab 158. The partition wall 196 should be located radially inward of the lid flange 182 so that when the control arm 136 pivots downwardly to open the drink opening, the partition wall 196 does not contact the lid flange and the lid flange does not interfere with the pivoting motion of the control arm.

Optionally, the partition wall 196 can be omitted as its presence merely helps to cover or hide the space in the lid channel 126 from view. When incorporated, the embankment 298 at the lid flange 182 can be appropriately shaped, such as tapered, to provide clearance for the partition wall 196 as the partition wall pivots downward during use of the control assembly 266. In some examples, the partition wall 196 can be sized and shaped to bottom out against the channel floor 128 when the control arm is pivoted to limit the pivot range of motion of the control arm 136.

One or more limiting fins 300 can be located on each of the two side edges 270 of the body of the control arm 136. In an example, the pivot pin 268 and the one or more limiting fins 300 closest of to the pivot pin on each side edges 270 should be spaced in a manner that allows the one or more limiting fins to clear the curved edge section 286 of the lower edge 280 of the channel wall 264, such as when the control arm 236 pivots downwardly and upwardly when mounted at the lid channel 126. The one or more limiting fins 300 extend from each side edge 270 of the control arm 136 and is configurated to move between the upper edge 278 and the lower edge 280 of the channel sidewall when the control arm pivots.

The one or more limiting fins are configured to move between the upper and lower side edges 278, 280 to limit the pivot range of motion of the control arm 136. Said differently, whereas the width between the two side edges 270 of the control arm 136 fits between the two outward most surfaces 276 of the lid channel 126, the width between the two set of ribs 300 is larger and fits within the gap or width defined by the two recessed wall sections 272 on the two channels walls 264. Thus, when the control arm 136 pivots up and down, such as when pressed downward to pivot downward by a user and when allowed to pivot upwardly by the return spring, the range of pivoting is limited by the one or more ribs on each side edge abutting the upper edge 278 and the lower edge 280.

In the example shown, two long ribs and one short rib are provided on each side edge 270 of the control arm. The ribs can be spaced from one another by a gap. However, there can be one long rib, two long ribs, multiple short ribs, or any combination of ribs used with the side edges 270 of the control arm for cooperating with the upper and lower edges 278, 280 of the channel walls 264 to limit the pivoting range of the control arm.

In alternative example, the lower edge 280 of each of the two channel walls can be omitted and the range of rotation can instead be limited by the upper edge 278 and the partition wall or partition tab 296 abutting the channel floor 128. For example, when the control arm 236 pivots downwardly, the lower end of the partition wall 296 abuts the channel floor 128 to stop further downward pivot motion of the control arm. Still alternatively, any number of surfaces may be provided on the channel floor 128 or the lid flange 182 to limit the downward pivot of the control arm. In yet another alternative embodiment, the upper and lower edges 278, 280 can both be incorporated on each channel wall 264, but wherein the angular range between the two edges 278, 280 is larger than the range of motion of the control arm, which is limited in the downward pivot direction by the partition wall or partition tab 296 hitting the channel floor 128, or hitting other surfaces or structures, prior to the ribs 300 hitting the lower edges 280 of the two channel sidewalls 264.

With reference again to FIG. 2 and with continued reference to FIGS. 4A and 4B, the actuator 192 and the return spring 200 can be assembled the body 120 of the lid 102 in the manner discussed previously. The control assembly 266 can then slide between the upper and lower edges 178, 180 of the two recessed walls 272 with the curved end 154 in first while adjusting or pushing down on the primary post 196 so that the post slides below the body of the control arm 136. The control assembly 266 can then be pushed into the lid channel 126 until the two pivot pins 268 on the two sides of the control arm snap into the two corresponding retaining slots 270, which act as sockets to retain the two pivot pins during use of the drinking assembly 100. The control assembly 266 can pivot about an axis defined by the two pivot pins.

With reference now to FIG. 3, a cross-sectional side view of the drinking assembly 100 of FIG. 1 is shown with the control arm 136 in the pivoted position, pivoted downwardly at the pull tab or push tab 158 by an external force 302, such as a force generated by a user's finger. As shown, the slider controller 174 is in the first or forward position towards the central vertical axis of the base to move the slider blocking tab 258 away from the vertical blocking wall 162 (FIG. 4A) to allow the control arm 136 to pivot downwardly without obstruction. The control arm 136 presses down on the primary post 196, which then compresses the return spring 200 from a first compressed state shown in FIG. 2 to a second compressed state shown in FIG. 3.

In the second compressed state, the second end 200*b* of the return spring 200, which is pressed against the retaining cap 226, moves towards the first end 200*a* of the return spring, which is pressed against the channel floor 128. In other words, both the retaining cap and the second end of the spring move toward the channel floor when the control arm is pivoted during use to dispense liquid. The further compressed state of the return spring 200 generates a restoring spring force to return the control arm 136 to the rest position of FIG. 2 upon removal of the external force.

As the primary post 196 is deflected axially downwardly by the control arm 136 along a linear path defined by the bore 206 of the post support 208, the post gasket 218 is moved away from the lower surface of the channel floor 128 to terminate the seal between the post gasket and the lower surface 155 (FIG. 3) of the lid to then open the air pathway of the post support 208, which functions as a vent port for air venting into the through passage of the bore 206 as fluid dispenses out the drink opening 166. Movement of the primary post is generally parallel to the central vertical axis of the drinking vessel. In an example, the lower surface 155 where the lower opening of the bore 206 is located can optionally include a recessed seat 157 for receiving at least part of the post gasket 218.

Because the primary post 196 is connected to the seal post 194 by the connecting bridge 198, downward movement of the primary post 196 causes the seal post 194 to move axially downwardly, also along a path that is generally parallel to the central vertical axis of the drinking vessel. This in turn moves the drink opening seal 190 away from the opening seat 204 to open the drink opening 166. Fluids can then dispense out the drink opening while air can vent into the interior of the drinking vessel via the through bore 206.

In an example, the slider controller 174 incorporates a slider hold 306 to regulate sliding movement of the slider controller 174. The slider hold 306, which can be a slider hold lever or bar, can be incorporated to resist sliding movement between the first position to lock the control arm and the second position to permit pivoting movement of the control arm. In an example, the slider hold 306 comprises a flange or a tab that can deflect to move between two different grooves 308, 310 on the control arm. When the slider controller 174 slides between the two positions, the flange or tab of the slider hold 306 can snap in and out of the two grooves when moving the slider controller 174 between the two positions.

The engagement between the slider hold and the two different grooves allows the slider controller to remain in either the first or the second position until purposely moved to the other position when a sufficient axial force is imparted to deflect the flange or tab out of engagement with the respective groove. As shown, the slider hold 306 is located in the groove that corresponds to the second position or unlock position, which moves the slider blocking tabs 258 away from the vertical blocking walls 262 on the two channel sidewalls 264 to allow the control arm to pivot downwardly.

Figure 5:
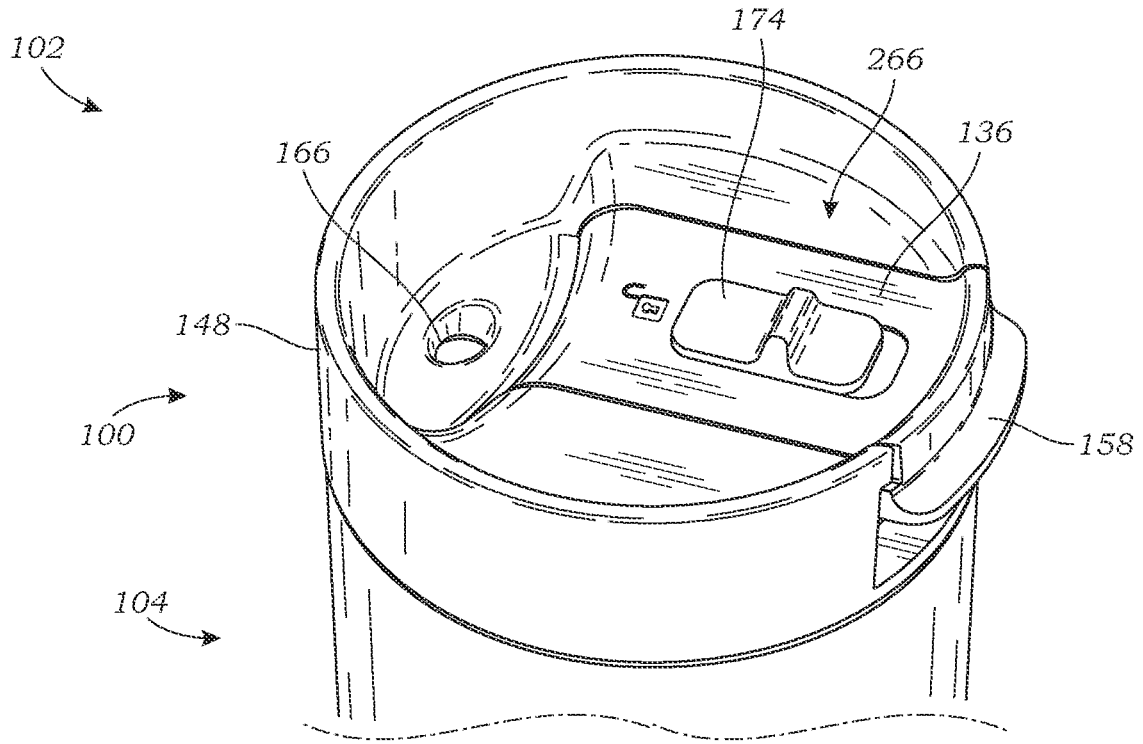
FIG. 5 is a partial top perspective view of FIG. 1 with the control arm in an unlocked and rest position, without any external force acting on the flange of the control arm.
Figure 6:
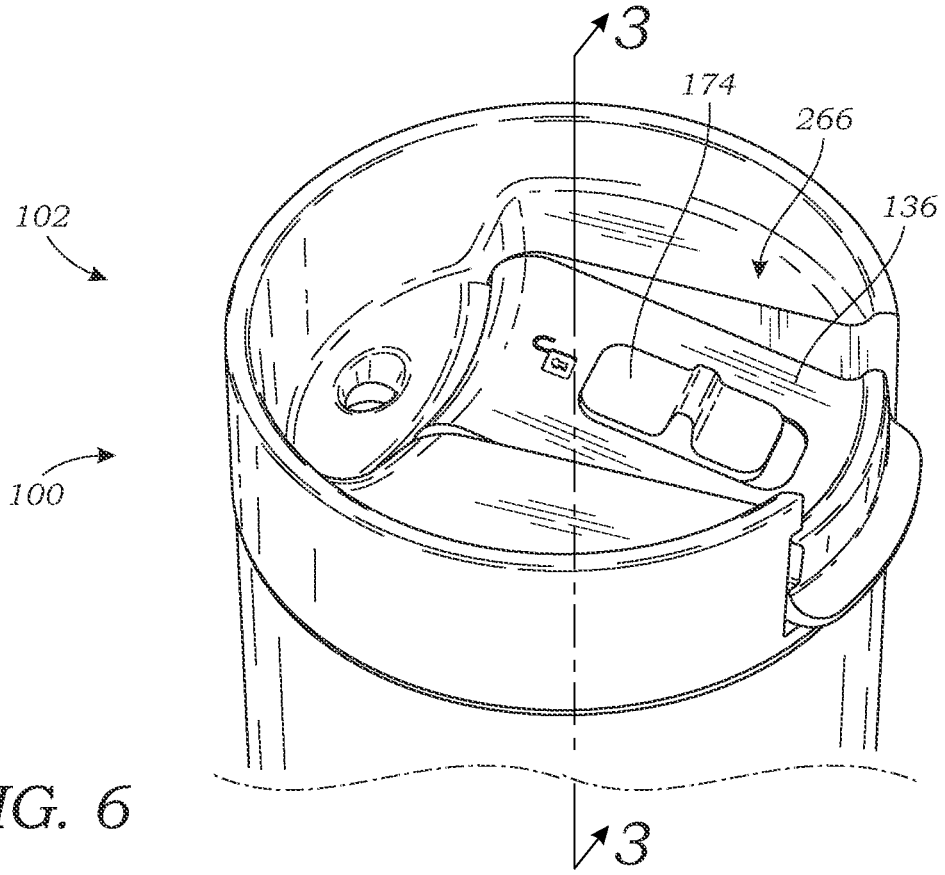
FIG. 6 is a partial top perspective view of FIG. 1 with the control arm in an unlocked and pivoted position, with an external force acting on the flange of the control arm to pivot the control arm.

FIG. 6 is a partial top perspective view of the drink assembly of FIG. 3, in which the slider controller 174 is in the second position, or unlock position, and the control arm 136 is pivoted downwardly to open the drink opening 166, as previously discussed. FIG. 5 shows the same slider controller second position but prior to the control arm being pushed downwardly on the push tab 158 to pivot, to open the drink opening.

Figure 7:
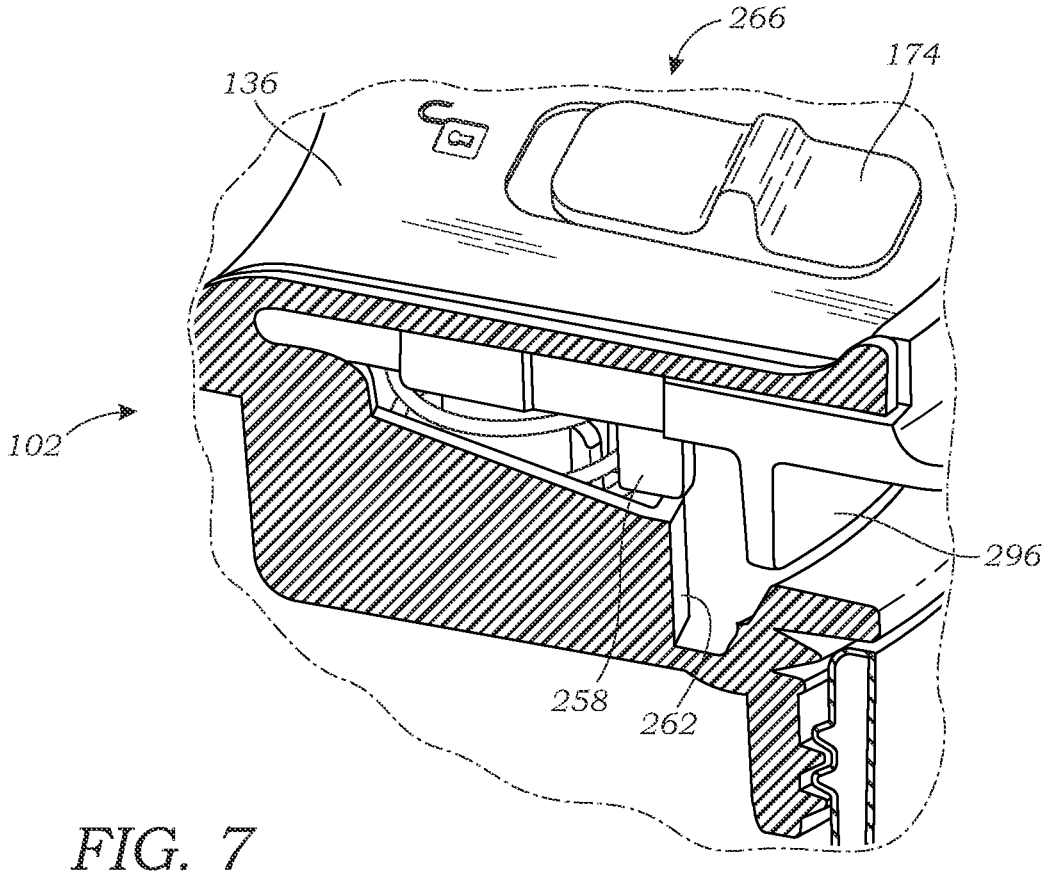
FIG. 7 is a side sectional perspective view of the lid assembly showing features of the control assembly.
Figure 8:
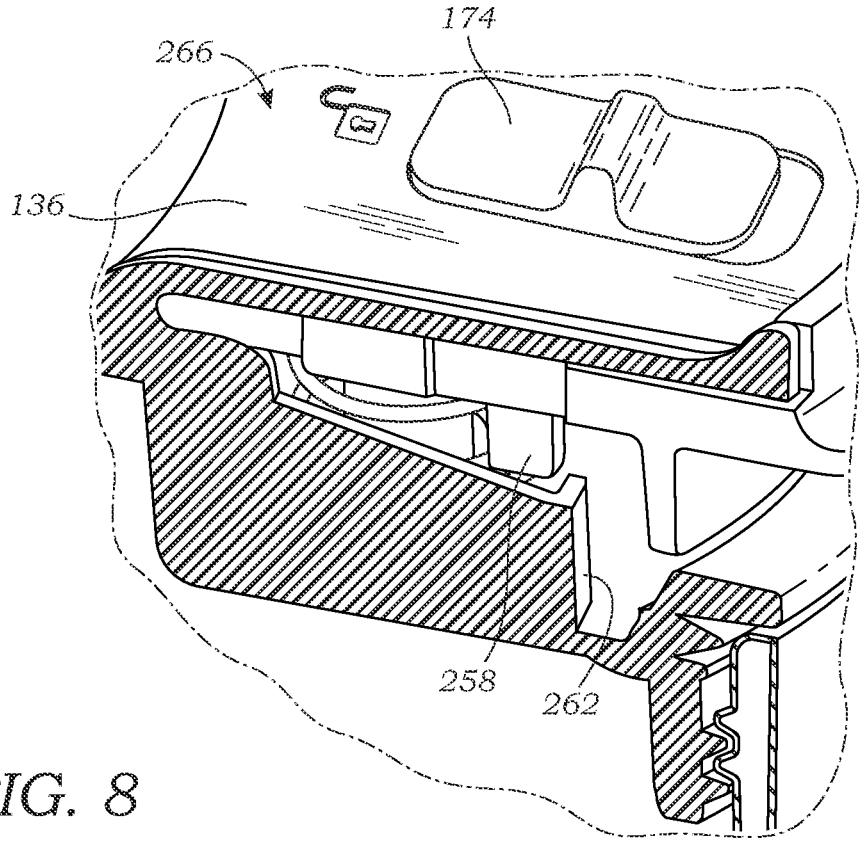
FIG. 8 is a side sectional perspective view of the lid assembly showing additional features of the control assembly.

FIG. 7 is a partial sectional view showing the slider controller 174 in the first position, or locked position, and the slider blocking tab 258 located directly over the vertical blocking wall 262, which physically obstructs the control arm 136 that is connected to the slider controller 174 from pivoting downward. FIG. 8 shows the same sectional view as FIG. 7 but with the slider controller 174 in the second position, or unlocked position. In this position, the slider blocking tab 258 is moved away from the vertical blocking wall and therefore not obstructed from moving downwards by the latter. Thus, the control arm 136 is not obstructed and can therefore pivot downwardly when a downward external force is applied to the push tab 158.

Figure 9:
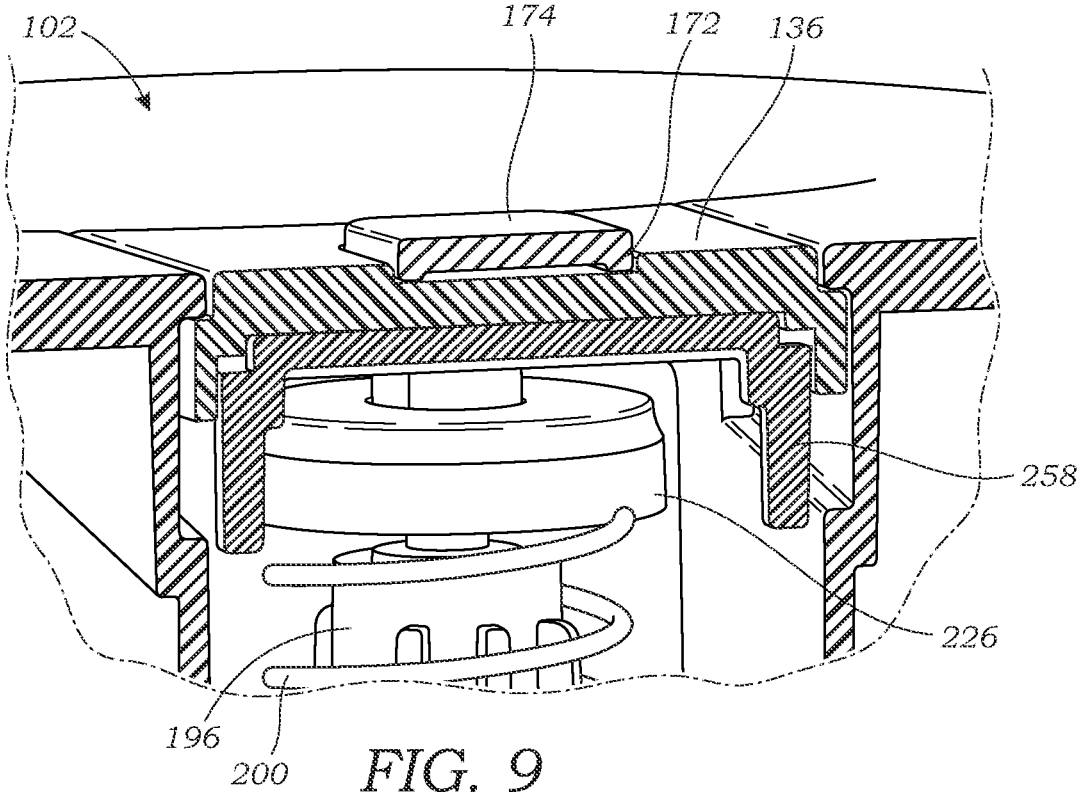
FIG. 9 is an end sectional perspective view of the lid assembly showing features of the control assembly.

FIG. 9 is a sectional end-view through the control assembly 266. In the view shown, the slider controller 174 is shown located in the recess 172 of the control arm 136. A slider follower 250 is shown located below the control arm. The slider follower 250 is shown with a pair of unitarily formed slider blocking tab 258.

Figure 10:
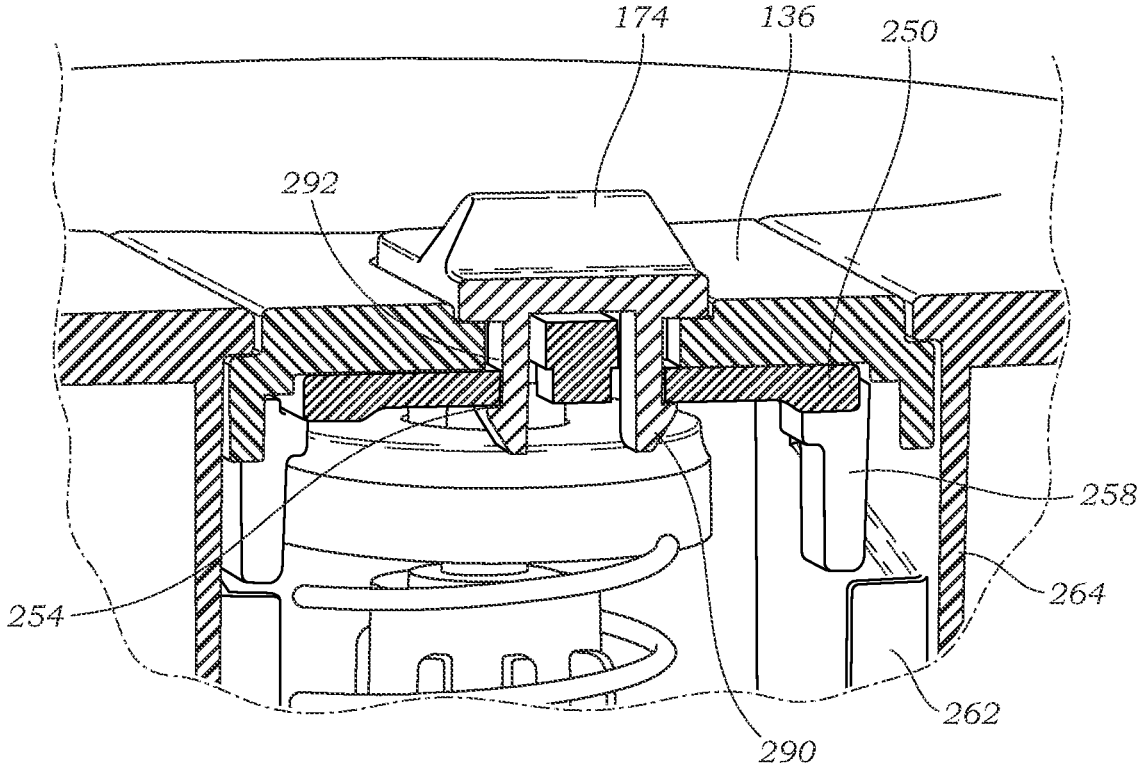
FIG. 10 is an end sectional perspective view of the lid assembly showing additional features of the control assembly.

FIG. 10 shows the same sectional view as FIG. 9 but with the cross-sectional line moved radially towards the push tab of the control arm 136. In the present view, the slider controller 174 is shown with a pair of unitarily formed latching fingers 290 projecting through the corresponding receiving slots 292 at the recess area of the control arm 136 and then latching against the edge of the retention slots 254 on the slider follower 250. The slider controller 174 is shown in the second position or unlocked position, with the slider blocking tabs 258 located inwardly away from the vertical blocking walls 262. In this unlocked position, the control arm can be pivoted downwardly to open the drink opening 166.

Figure 11:
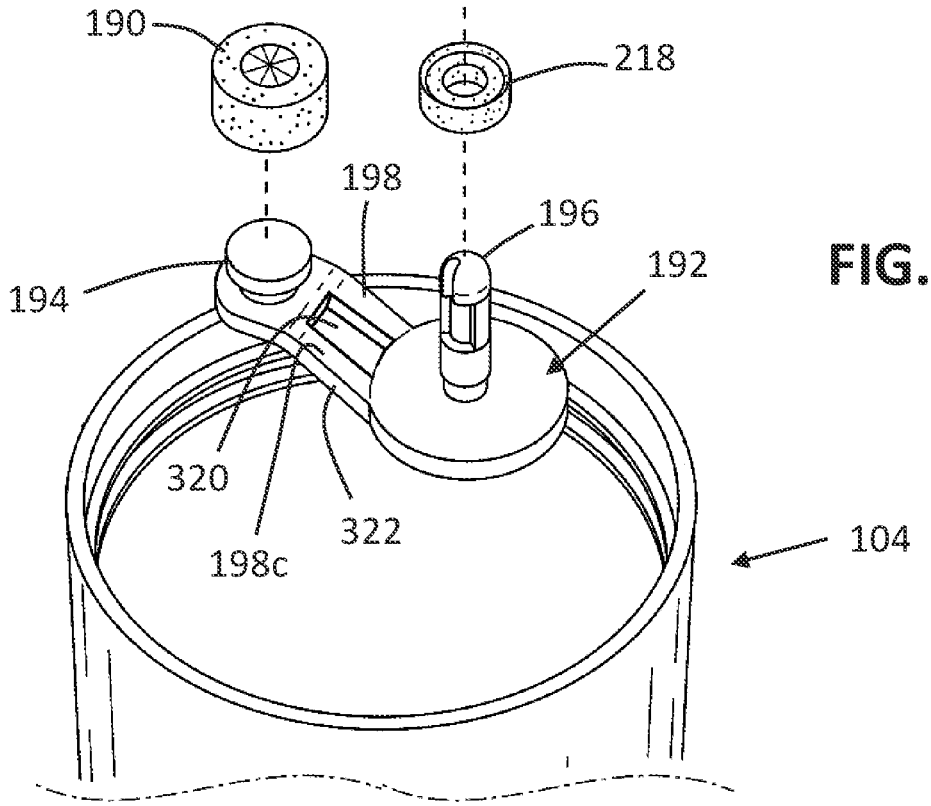
FIG. 11 is a perspective exploded view of an actuator provided in accordance with further aspects of the invention.

With reference now to FIG. 11, an actuator 192 in accordance with further aspects of the invention, which is similar to other actuators described with a few exceptions. In the present embodiment, a bridge channel 198 is provided with the actuator. The bridge channel 320 can be an elongated cut-out formed into or in through the central connecting portion 198*c* of the actuator. In an example, the bridge channel 320 can have a bottom wall or can be formed as a through channel, without the bottom wall.

The length of the bridge channel 320 can be short of the full length of the connecting portion or can extend the full length of the connecting portion. Thus, bridge channel 320 can have a cut-out with two lengthwise sidewalls and two end walls that connect to the two lengthwise sidewalls. However, the bridge channel can have other shapes, such as oval, oblong, square, an elongated irregular shape, or even a round shape. Thus, the bridge channel has a perimeter that is located inwardly of the perimeter of the bridge 198, and inwardly of the two side edges 322 of the bridge. As further discussed below, the bridge channel 320 is sized and shaped to cooperate with a guide 326 (FIGS. 12 and 13) formed to the lid channel wall 328 for maintaining the angular position of the bridge.

Figure 12:
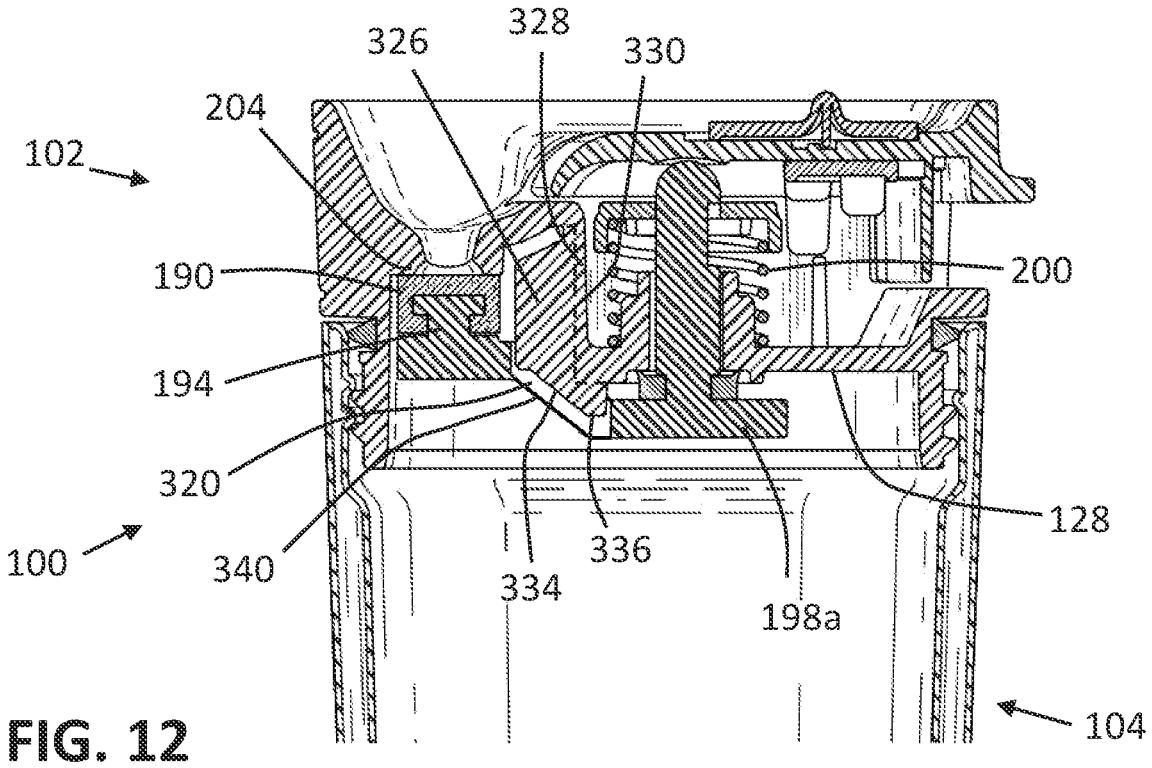
FIG. 12 is a cross-sectional side view of a drink assembly of having the actuator of FIG. 11.

With reference to FIG. 12 in addition to FIG. 11, the actuator 192 is shown in a closed position, in which the control arm 136 is in the rest position and the return spring 200 is in the first compressed state. Also shown is a guide 326 that is formed with the lid channel wall 328. In an example, the guide 326 embodies a fin or rib structure that extends from the vertical wall 330 and the channel floor 128 of the lid channel wall 328, which have been depicted as dash lines to delineate the boundaries between the rib structure of the guide 326 and the vertical wall and floor. The guide has a thickness that is less than the width of the bridge channel 320 so that the bridge channel can receive the guide 326 in the actuator closed position shown.

The guide 326 has a guide bottom edge 334 and a guide bottom section 336. In an example, the guide bottom edge 334 is angled or sloped, generally similarly to the slope of the bridge 198. However, the guide bottom edge 334 can have a different slope or can have different edges or structures so long as the guide bottom edge 334 can be located within the bridge channel 320 during movement of the actuator 192 between the closed position shown in FIG. 12 and the actuated position shown in FIG. 13.

As the actuator 192 is rotatable about the axis of the primary post 196, the angular position of the seal post 194 and the drink opening seal 190 can rotate out of alignment with the drink opening seat 204. Thus, by utilizing the guide 326 and the bridge channel 320, the angular position of the seal post 194 and the drink opening seal 190 relative to the drink opening seat 204 can be maintained during movement of the actuator between the closed position and the actuated position.

In an example, the guide bottom edge 334 and the guide bottom section 336 of the guide 326 are maintained within the lowest most plane or edge 340 of the bridge channel 320. Thus, the bridge channel 320 can have a bottom wall, or is not a through channel, and the guide can still be guided within the bridge channel during movement of the actuator. However, the bridge channel 320 is preferably a through channel, which facilitates cleaning and reduce material costs.

Figure 13:
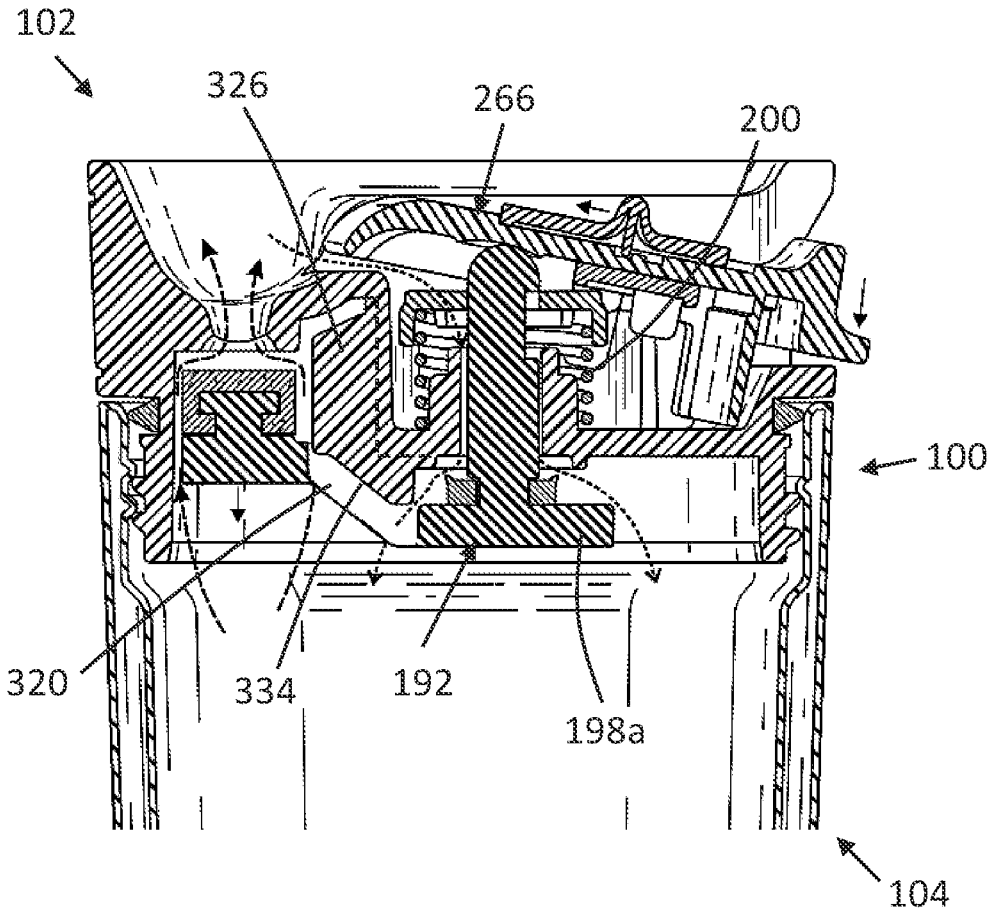
FIG. 13 is a cross-sectional side view of the drink assembly of FIG. 12 showing the actuator in the activated position.

FIG. 13 shows the actuator 192 in the actuated position, where air can vent into the container vessel and liquid can dispense out the drink opening of the lid. In the actuated position, the coils of the return spring 200 are not bottomed out. In other words, the return spring 200 can still compress or travel further if additional compressive force is applied to the return spring 200.

With reference again to FIG. 12 and with continued reference to FIG. 13, and if the lid assembly 102 has been detached from the container vessel 104, the actuator 192 can be rotated for cleaning without removing the control assembly 266 (FIG. 4A) and the actuator 192 from the lid body, which remains an option. To move the actuator 192 to a cleaning mode, the user can grip the first end 198*a* of the actuator and pull on the first end to further compress the return spring 200, further than the second compressed state of FIG. 13. This further compressed state of the return spring 200 can be referred to as the third compressed state.

In the third compressed state, the coils of the return spring 200 can bottom out and can no longer compress or can still compress. The third compressed state allows the bridge 198 of the actuator 192 to clear from the physical obstruction of the guide bottom edge 334 of the guide 326. Once the bridge 198 clears the guide bottom edge 334, the bridge can now rotate about the axis of the primary post 136. The bridge 198 can rotate clockwise or counter-clockwise from its starting position, which can be considered the zero angular position or the position in which the guide channel 320 is aligned to receive the guide 326. The bridge 198 can rotate, clockwise or counter-clockwise, to move to one side of the guide 326.

This rotation moves the drink opening seal 190 away from the drink opening, to expose the drink opening. The user can now release the actuator and allow the return spring to expand until restricted by contacts between one or more components of the actuator and the lid body. The rotated bridge therefore moves the actuator to a cleaning position, which exposes the drink opening without having to completely remove the control assembly and the actuator from the lid body.

To return the actuator to the zero angular position, such as for use or operation, the process is reversed. The user can pull on the first end 198*a* of the bridge to compress the spring to the third compressed state to clear the bridge from the guide bottom edge of the guide. The actuator is then rotated to align the bridge channel 320 with the guide 326. The user can then release the grip on the actuator and allow the return spring to return to the second compressed state.

The assembly for drinking of FIGS. 11-13 may operate as discussed above with reference to FIGS. 1-10.

Aspects of the disclosed drinking assembly, as discussed elsewhere herein, show the drinking vessel 104 as having a double wall structure with a gap therebetween. The gap can be vacuum sealed using traditional double wall vacuum sealed construction. The double wall construction is preferably made from a stainless steel material.

In an example, the threaded open top of the drinking vessel 104 comprises female threads configured for receiving male threads on the lid assembly. For example, the lid assembly can comprise a skirt section with male threads for threaded engagement with the female threads.

In an example, the slider controller first position can be located further away from the drink opening than the slider controller second position.

The lid assembly can further comprise a slider follower located below, elevation-wise, the control arm and the slider controller. The slider follower can couple directly to the slider controller and slidable by the slider controller.

The slider controller can have a projection that rises above a planar body of the slider controller. The projection on the slider controller can provide a gripping point or a leverage point to push or pull on the slider to move it between a first position and a second position.

The slider controller can further comprise a slider hold, which can be a fin, a lever, or a bar. The slider hold can be located at the projection and wherein the slider hold can have an edge for interacting with a bar bump or a groove located on the control arm to control movement of the slider controller between the first position and the second position. There can be two different grooves, each interacting with the slider hold to retain the slider in a first position, or in a second position.

The slider controller can further comprise a slider latch extending from a lower surface and extending through a gap in the control arm.

The slider latch can extend through a gap in the slider follower and engage the slider follower in a detent engagement.

The slider latch can be a first slider latch and wherein the slider controller can further comprise a second slider latch spaced from the first slider latch.

The second slider latch can extend through a second gap in the slider follower and engaging the slider follower in a detent engagement.

A slider blocking tab can extend from a lower surface of the slider follower, and wherein the slider blocking tab can be slidable towards the central vertical axis and away from the central vertical axis.

The lid channel can comprise a lid channel wall and a channel blocking tab extending outwardly from the lid channel wall.

The slider blocking tab can be aligned to be blocked by the channel blocking tab to prevent rotational movement or pivotal movement of the control arm.

The slider blocking tab can be out of alignment with the channel blocking tab or wall to permit rotational movement of the control arm.

The lid channel can comprise two spaced apart channel walls defining a channel width, and wherein each channel wall can comprise a retaining slot comprising a rounded end.

The control arm can comprise two spaced apart pivot pins, and wherein each pivot pin is located in a respective retaining slot of the lid channel. Each retaining slot can have a reduced section and an end section, and wherein the pivot pin is configured to move over the reduced section and situated at the end section.

The control arm has two side edges, and wherein each side edge has one of the two pivot pins.

Each retaining slot on the channel sidewalls can have a narrowed portion forming a detent to retain a respective pivot pin of the control arm.

A fin or rib can extend from each of the two side wedges of the control arm.

The end surfaces of the fins on the two side edges define a width, and the two pivot pins define a width, and wherein the width defined by the two fins is larger than the width defined by the fins.

The control arm can have a pull tab extending radially outwardly away from the central vertical axis. The pull tab can be located further away from the vertical axis than the rim piece.

The control arm can comprise a curved end opposite the pull tab. The curved end can form part of an embankment of the well.

A first pin can be located on a first side edge of the control arm and a second pin can be located on a second side edge of the control arm.

The primary post on the actuator can be located atop a disc-shaped portion of the bridge. The post can have a nominal diameter section, channels, and undercuts.

A post gasket can be located in a notch, adjacent to the disc-shaped portion.

The post gasket can be pressed against a lower surface of the channel floor to seal a lower opening of the bore of the post support in the rest position of the control arm. The lower opening can be an opening at a first end of a bore. The bore can have a second opening. The first and the second opening can define a through bore.

The post gasket can be spaced from the lower surface of the channel floor to not seal the lower opening of the bore of the post support in the pivoted position of the control arm. The through bore can allow air to vent into the container vessel when liquid is dispensed out the drink opening.

The bore of the post support can limit movement of the primary post along a path that is generally parallel to the central vertical axis. For example, the bore can be generally constant and functions like a sleeve bearing. The primary post sliding inside the bore is similar to a shaft sliding inside a sleeve and is bounded or fixed along an axis defined by the sleeve. The post support can be permanently fixed to the channel floor or can be removable from the channel floor.

The seal post can similarly move along a path that is generally parallel to the central vertical axis. The primary post and the seal post can have axes that are generally parallel and spaced from one another by a bridge portion. The bridge portion can be rigid, although some minor or negligible flexing can be expected. Thus, when the primary post moves axially along a vertical path, the seal post is moved by the primary post, via the bridge connection, along a vertical path.

The bridge can comprise a first bridge section connected to the seal post, a second bridge section connected to the primary post, and an intermediate bridge section that is angled to both the first bridge section and the second bridge section. The bottom of the seal post and the bottom of the primary post can be located on two different elevations in the installed position, such as shown in FIG. 2.

The rounded free end of the primary post can press against a rounded bearing surface on the control arm. The rounded bearing surface on the control arm can smooth the pivot travel of the control arm. Optionally, the rounded bearing surface can be omitted and the control arm can still press against the tip of the primary post to translate the actuator downwardly.

The control arm for opening the drink opening can have a body with a generally planar lower surface, and wherein the rounded bearing surface is surrounded by the generally planar lower surface.

The post support at the channel floor can have a first outside diameter section and a second outside diameter section that is smaller than the first outside diameter section, and wherein the bore passes through both the first and second outside diameter sections. The second outside diameter section can be located above the first outside diameter.

The return spring can be located around the first outside diameter section and the second outside diameter section. The second outside diameter section can be a solid cylindrical section. Alternatively, the post support can have a single diameter cylinder and the second outside diameter section is formed by providing spaced apart fins around the single diameter cylinder. The return spring can be a helical compression spring.

The primary post can have two vertical channels and two undercut sections. A retaining cap can comprise a central opening and a pair of tabs extending from the central opening. The retaining cap can be oriented to a first angular position to align the pair of tabs to the two vertical channels on the primary post and the retaining cap can be oriented to a second angular position and the pair of tabs are out of alignment with or from the two vertical channels. When the pair of tabs are slid down the two vertical channels and then rotated out of alignment, the retaining cap is secured to the primary post. The primary cap can be secured to the primary post to hold the return spring in a first compressed state.

Each of the pair of tabs of the retaining cap can be located in a respective undercut section in the second angular position of the retaining cap.

A post gasket can be secured or mounted to a bottom section of the primary post, at an undercut section formed by a shaft section with a shaft diameter that is smaller than another shaft diameter just above it. The post gasket and the drink opening seal can press against surfaces of the lid top in the control arm rest position.

The post gasket and the drink opening seal can be spaced from surfaces of the lid top substantially at about the same time when the control arm is moved to the pivoted position. When the control arm is pivoted, the control arm displaces an actuator, which can have both the primary post having the post gasket and the seal post having the drink opening seal.

The primary rim portion can occupy about 310 degrees to about 360 degrees of a circle.

The rim piece on the control arm and the primary rim portion can define a generally circular rim having two parting lines.

Methods of making and of using drink assemblies and components thereof, such as lid assemblies, are within the scope of the present invention.

Although limited embodiments of the drink assemblies and their components have been specifically described and illustrated herein, many modifications and variations will be apparent to those skilled in the art. Accordingly, it is to be understood that the drink assemblies and their components constructed according to principles of the disclosed device, system, and method may be embodied other than as specifically described herein. The disclosure is also defined in the following claims.

EXAMPLE EMBODIMENTS

The following are numbered example embodiments of the apparatuses, devices, systems, and methods related to water bottle or drinkware. Examples 1-70 or any other examples disclosed herein may be combined in whole or in part. Elements of the examples disclosed herein are not limiting.

Example 1

An assembly for drinking, said assembly comprising: a drinking vessel comprising a body having a central vertical axis, a threaded open top, and a closed bottom; a lid assembly threaded to the threaded open top of the drinking vessel, said lid assembly comprising: a lid top having surface with a cutout defining a lid channel having a channel floor and wherein the lid top is surrounded on an outer periphery by a primary rim section having a cut-out; a control arm pivotably mounted in the lid channel of the lid top, the control arm having a rim piece occupying the cut-out of the primary rim section and forming a rim portion at the control arm, a slider controller located within two side edges of the control arm, the slider controller movable between a first position to lock pivotable motion of the control arm and movable to a second position to unlock pivotable motion of the control arm; a clearance gap between a bottom of the control arm and a lid flange, the lid flange located below, elevation-wise, the surface of the lid top; a well having a well surface with a drink opening and wherein the well surface is located below, elevation-wise, the surface of the lid top; an actuator for opening and closing the drink opening, the actuator comprising a seal post having a drink opening seal mounted thereon and pressing against an opening seat in a seal closed position to close the drink opening, a primary post spaced from the seal post and projecting through a bore of a post support on the channel floor, and a bridge connecting the seal post and the primary post; a return spring mounted around the post support and biasing against the channel floor and a retaining cap that is removably attached to the primary post; wherein said return spring is in a first compressed state and biases the drink opening seal against the opening seat in the seal closed position when the control arm is in a rest position and not acted on by an external pivotable force; and wherein said return spring is in a second compressed state when the control arm is pivoted by an external force to a pivoted position to move the primary post generally parallel to the central vertical axis, which moves the seal post generally parallel to the central vertical axis to move the drink opening seal away from the opening seat to open the drinking opening. The assembly for drinking can be a water bottle or a drinkware.

Example 2

The water bottle or drinkware, apparatus, assembly, and method of any of Examples 1-70 or any other embodiment described herein, wherein the drinking vessel has a double wall structure with a gap therebetween.

Example 3

The water bottle or drinkware, apparatus, assembly, and method of any of Examples 1-70 or any other embodiment described herein, wherein the threaded open top is a female thread receiving male threads on the lid assembly.

Example 4

The water bottle or drinkware, apparatus, assembly, and method of any of Examples 1-70 or any other embodiment described herein, wherein the slider controller first position is located further away from the drink opening than the slider controller second position.

Example 5

The water bottle or drinkware, apparatus, assembly, and method of any of Examples 1-70 or any other embodiment described herein, further comprising a slider follower located below, elevation-wise, the control arm and the slider controller, the slider follower slidable by the slider controller.

Example 6

The water bottle or drinkware, apparatus, assembly, and method of any of Examples 1-70 or any other embodiment described herein, wherein the slider controller has a projection that rises above a planar body of the slider controller.

Example 7

The water bottle or drinkware, apparatus, assembly, and method of any of Examples 1-70 or any other embodiment described herein, wherein the slider controller further comprising a slider holder bar located at the projection having an edge for interact with a bar bump located on the control arm to control movement of the slider controller between the first position and the second position.

Example 8

The water bottle or drinkware, apparatus, assembly, and method of any of Examples 1-70 or any other embodiment described herein, wherein the slider controller further comprises a slider latch extending from a lower surface and extending through gap in the control arm.

Example 9

The water bottle or drinkware, apparatus, assembly, and method of any of Examples 1-70 or any other embodiment described herein, wherein slider latch further extends through a gap in the slider follower and engaging the slider follower in a detent engagement.

Example 10

The water bottle or drinkware, apparatus, assembly, and method of any of Examples 1-70 or any other embodiment described herein, wherein the slider latch is a first slider latch and wherein the slider controller further comprises a second slider latch spaced from the first slider latch.

Example 11

The water bottle or drinkware, apparatus, assembly, and method of any of Examples 1-70 or any other embodiment described herein, wherein the second slider latch extends through a second gap in the slider follower and engaging the slider follower in a detent engagement.

Example 12

The water bottle or drinkware, apparatus, assembly, and method of any of Examples 1-70 or any other embodiment described herein, further comprising a slider blocking tab extending from a lower surface of the slider follower, and wherein the slider blocking tab is slidable towards the central vertical axis and away from the central vertical axis.

Example 13

The water bottle or drinkware, apparatus, assembly, and method of any of Examples 1-70 or any other embodiment described herein, wherein the lid channel comprises a lid channel wall and a channel blocking tab extending outwardly from the lid channel wall.

Example 14

The water bottle or drinkware, apparatus, assembly, and method of any of Examples 1-70 or any other embodiment described herein, wherein the slider blocking tab is aligned to be blocked by the channel blocking tab to prevent rotational movement of the control arm.

Example 15

The water bottle or drinkware, apparatus, assembly, and method of any of Examples 1-70 or any other embodiment described herein, wherein the slider blocking tab is out of alignment with the channel blocking tab to permit rotational movement of the control arm.

Example 16

The water bottle or drinkware, apparatus, assembly, and method of any of Examples 1-70 or any other embodiment described herein, wherein the lid channel comprises two spaced apart channel walls defining a channel width, and wherein each channel wall comprises a retaining slot comprising a rounded end.

Example 17

The water bottle or drinkware, apparatus, assembly, and method of any of Examples 1-70 or any other embodiment described herein, wherein the control arm comprises two spaced apart pivot pins, and wherein each pivot pin is located in a respective retaining slot of the lid channel.

Example 18

The water bottle or drinkware, apparatus, assembly, and method of any of Examples 1-70 or any other embodiment described herein, wherein the control arm has two side edges, and wherein each side edge has one of the two pivot pins.

Example 19

The water bottle or drinkware, apparatus, assembly, and method of any of Examples 1-70 or any other embodiment described herein, wherein each retaining slot has a narrowed portion forming a detent to retain a respective pivot pin.

Example 20

The water bottle or drinkware, apparatus, assembly, and method of any of Examples 1-70 or any other embodiment described herein, further comprising a fin extending from each of the two side wedges.

Example 21

The water bottle or drinkware, apparatus, assembly, and method of any of Examples 1-70 or any other embodiment described herein, wherein the end surfaces of the fins on the two side edges define a width, and the two pivot pins define a width, and wherein the width defined by the two fins is larger than the width defined by the fins.

Example 22

The water bottle or drinkware, apparatus, assembly, and method of any of Examples 1-70 or any other embodiment described herein, wherein control arm has a pull tab extending radially outwardly away from the central vertical axis.

Example 23

The water bottle or drinkware, apparatus, assembly, and method of any of Examples 1-70 or any other embodiment described herein, wherein the control arm further comprises a curved end opposite the pull tab.

Example 24

The water bottle or drinkware, apparatus, assembly, and method of any of Examples 1-70 or any other embodiment described herein, wherein the curved end forming part of an embankment of the well.

Example 25

The water bottle or drinkware, apparatus, assembly, and method of any of Examples 1-70 or any other embodiment described herein, further comprising a first pin located on a first side edge of the control arm and a second pin located on a second side edge of the control arm.

Example 26

The water bottle or drinkware, apparatus, assembly, and method of any of Examples 1-70 or any other embodiment described herein, wherein the primary post is located atop a disc-shaped portion of the bridge.

Example 27

The water bottle or drinkware, apparatus, assembly, and method of any of Examples 1-70 or any other embodiment described herein, wherein the primary post comprises a rounded free end a notch adjacent to the disc-shaped portion.

Example 28

The water bottle or drinkware, apparatus, assembly, and method of any of Examples 1-70 or any other embodiment described herein, further comprising post gasket located in the notch.

Example 29

The water bottle or drinkware, apparatus, assembly, and method of any of Examples 1-70 or any other embodiment described herein, wherein the post gasket is pressed against a lower surface of the channel floor to seal a lower opening of the bore of the post support in the rest position of the control arm.

Example 30

The water bottle or drinkware, apparatus, assembly, and method of any of Examples 1-70 or any other embodiment described herein, wherein the post gasket is spaced from the lower surface of the channel floor to not seal the lower opening of the bore of the post support in the pivoted position of the control arm.

Example 31

The water bottle or drinkware, apparatus, assembly, and method of any of Examples 1-70 or any other embodiment described herein, wherein the bore of the post support limits movement of the primary post along a path that is generally parallel to the central vertical axis.

Example 32

The water bottle or drinkware, apparatus, assembly, and method of any of Examples 1-70 or any other embodiment described herein, wherein the seal post moves along a path that is generally parallel to the central vertical axis.

Example 33

The water bottle or drinkware, apparatus, assembly, and method of any of Examples 1-70 or any other embodiment described herein, wherein the bridge comprises a first bridge section connected to the seal post, a second bridge section connected to the primary post, and an intermediate bridge section that is angled to both the first bridge section and the second bridge section.

Example 34

The water bottle or drinkware, apparatus, assembly, and method of any of Examples 1-70 or any other embodiment described herein, wherein the rounded free end of the primary post is pressed against a rounded bearing surface on the control arm.

Example 35

The water bottle or drinkware, apparatus, assembly, and method of any of Examples 1-70 or any other embodiment described herein, wherein the control arm has a generally planar lower surface, and wherein the rounded bearing surface is surrounded by the generally planar lower surface.

Example 36

The water bottle or drinkware, apparatus, assembly, and method of any of Examples 1-70 or any other embodiment described herein, wherein the post support has a first outside diameter section and a second outside diameter section that is smaller than the first outside diameter section, and wherein the bore passes through both the first and section outside diameter sections.

Example 37

The water bottle or drinkware, apparatus, assembly, and method of any of Examples 1-70 or any other embodiment described herein, wherein the return spring is located around the first outside diameter section and the second outside diameter section.

Example 38

The water bottle or drinkware, apparatus, assembly, and method of any of Examples 1-70 or any other embodiment described herein, wherein the primary post has two vertical channels and two undercut sections.

Example 39

The water bottle or drinkware, apparatus, assembly, and method of any of Examples 1-70 or any other embodiment described herein, wherein the retaining cap comprises a central opening and a pair of tabs extending from the central opening.

Example 40

The water bottle or drinkware, apparatus, assembly, and method of any of Examples 1-70 or any other embodiment described herein, wherein the retaining cap is oriented to a first angular position to align the pair of tabs to the two vertical channels.

Example 41

The water bottle or drinkware, apparatus, assembly, and method of any of Examples 1-70 or any other embodiment described herein, wherein the retaining cap is oriented to a second angular position and the pair of tabs are not aligned to the two vertical channels to secure the retaining cap to the primary post.

Example 42

The water bottle or drinkware, apparatus, assembly, and method of any of Examples 1-70 or any other embodiment described herein, wherein each of the pair of tabs is located in a respective undercut section in the second angular position of the retaining cap.

Example 43

The water bottle or drinkware, apparatus, assembly, and method of any of Examples 1-70 or any other embodiment described herein, further comprising a post gasket secured to a bottom section of the primary post, and wherein the post gasket and the drink opening seal are pressed against surfaces of the lid top in the control arm rest position.

Example 44

The water bottle or drinkware, apparatus, assembly, and method of any of Examples 1-70 or any other embodiment described herein, wherein the post gasket and the drink opening seal are spaced from surfaces of the lid top substantially at about the same time when the control arm is moved to the pivoted position.

Example 45

The water bottle or drinkware, apparatus, assembly, and method of any of Examples 1-70 or any other embodiment described herein, wherein the primary rim portion occupies about 310 degrees to about 360 degrees of a circle.

Example 46

The water bottle or drinkware, apparatus, assembly, and method of any of Examples 1-70 or any other embodiment described herein, wherein the rim piece and the primary rim portion define a generally circular rim having two parting lines.

Example 47

An assembly for drinking, said assembly comprising: a drinking vessel comprising a body having a central vertical axis, a threaded open top, and a closed bottom; a lid assembly threaded to the threaded open top of the drinking vessel, said lid assembly comprising: a lid top having surface with a cutout defining a lid channel having a channel floor and wherein the lid top is surrounded on an outer periphery by a primary rim section having a cut-out; a control arm pivotably mounted in the lid channel of the lid top, the control arm having a rim piece occupying the cut-out of the primary rim section and forming a rim portion that forms a ring with the primary rim section, a slider controller located within two side edges of the control arm, the slider controller movable between a first position to lock pivotable motion of the control arm and movable to a second position to unlock pivotable motion of the control arm; a well having a well surface with a drink opening and an embankment; an actuator for opening and closing the drink opening, the actuator comprising a seal post having a drink opening seal mounted thereon and pressing against an opening seat in a seal closed position to close the drink opening, a primary post spaced from the seal post and projecting through a bore of a post support on the channel floor, and a bridge connecting the seal post and the primary post; and a return spring mounted around the post support and biasing against the channel floor and a retaining cap that is removably attached to the primary post. The assembly for drinking can be a water bottle or a drinkware.

Example 48

The water bottle or drinkware, apparatus, assembly, and method of any of Examples 1-70 or any other embodiment described herein, wherein the return spring is in a first compressed state and biases the drink opening seal against the opening seat in the seal closed position when the control arm is in a rest position and not acted on by an external pivotable force.

Example 49

The water bottle or drinkware, apparatus, assembly, and method of any of Examples 1-70 or any other embodiment described herein, wherein said return spring is in a second compressed state when the control arm is pivoted by an external force to a pivoted position to move the primary post generally parallel to the central vertical axis, which moves the seal post generally parallel to the central vertical axis to move the drink opening seal away from the opening seat to open the drinking opening.

Example 50

The water bottle or drinkware, apparatus, assembly, and method of any of Examples 1-70 or any other embodiment described herein, further comprising a slider follower located below, elevation-wise, the control arm and the slider controller, the slider follower slidable by the slider controller.

Example 51

The water bottle or drinkware, apparatus, assembly, and method of any of Examples 1-70 or any other embodiment described herein, wherein the lid channel comprises two spaced apart channel walls defining a channel width, and wherein each channel wall comprises a retaining slot comprising a rounded end.

Example 52

The water bottle or drinkware, apparatus, assembly, and method of any of Examples 1-70 or any other embodiment described herein, wherein the control arm has a pull tab extending radially outwardly away from the central vertical axis.

Example 53

A method of using an assembly for drinking, wherein the assembly comprising: a drinking vessel comprising a body having a central vertical axis, a threaded open top, and a closed bottom: a lid assembly threaded to the threaded open top of the drinking vessel, said lid assembly comprising: a lid top having surface with a cutout defining a lid channel having a channel floor and wherein the lid top is surrounded on an outer periphery by a primary rim section having a cut-out; a control arm pivotably mounted in the lid channel of the lid top, the control arm having a pull tab and a rim piece occupying the cut-out of the primary rim section and forming a rim portion at the control arm, a slider controller located within two side edges of the control arm; a well having a well surface with a drink opening and wherein the well surface is located below, elevation-wise, the surface of the lid top; an actuator for opening and closing the drink opening, the actuator comprising a seal post having a drink opening seal mounted thereon and pressing against an opening seat in a seal closed position to close the drink opening, a primary post spaced from the seal post and projecting through a bore of a post support on the channel floor, and a bridge connecting the seal post and the primary post; a return spring mounted around the post support and biasing against the channel floor and a retaining cap that is removably attached to the primary post; wherein the method comprises the steps: pushing down on the pull tab to rotate the control arm about a pivoting axis; generating a downward force on the primary post with the control arm to move the primary post along a linear path parallel to the central vertical axis; and moving the seal post downwardly away from the opening seat with the bridge connected to the primary post to open the drink opening. The assembly for drinking can be a water bottle or a drinkware.

Example 54

The water bottle or drinkware, apparatus, assembly, and method of any of Examples 1-70 or any other embodiment described herein, further comprising sliding a pair of pivot pins radially away from the central vertical axis to remove the pivot pins from a pair of retaining slots to separate the control arm from the lid top.

Example 55

The water bottle or drinkware, apparatus, assembly, and method of any of Examples 1-70 or any other embodiment described herein, further comprising moving adjusting, or manipulating any of the components of the water bottle or drinkware.

Example 56

An assembly for drinking comprising a lid assembly threaded attached to a container vessel, wherein the lid assembly comprises: a lid top having surface with a cutout defining a lid channel having a channel floor and wherein the lid top is surrounded on an outer periphery by a primary rim section having a cut-out and a drink opening; a control assembly positioned in the lid channel and pivotable about a pivoting axis, said control assembly comprising a slider controller slidably positioned on an upper surface of a control arm and a slider follower positioned below a lower surface of the control arm; an actuator comprising a primary post in abutting contact with the control arm of the control assembly and a seal post having a drink opening seal pressed against an opening seat by a return spring to seal the drink opening; and wherein the slider controller is mechanically attached to the slider follower and movement of the slider controller directly moves the slider follower. The assembly for drinking can be a water bottle or a drinkware.

Example 57

The water bottle or drinkware, apparatus, assembly, and method of any of Examples 1-70 or any other embodiment described herein, wherein the control arm has a first pin on a first side edge and a second pin on a second side edge, and wherein the first and second pins are located in sockets in the lid channel to define the pivoting axis.

Example 58

The water bottle or drinkware, apparatus, assembly, and method of any of Examples 1-70 or any other embodiment described herein, wherein the control assembly only pivots and not translate to push on the primary post of the actuator to open the drink opening.

Example 59

The water bottle or drinkware, apparatus, assembly, and method of any of Examples 1-70 or any other embodiment described herein, wherein an opening on the lid top where the primary post projects through and the drink opening open substantially simultaneously when the control assembly rotates to a pivoted position.

Example 60

An assembly for drinking comprising a lid assembly threaded attached to a container vessel, wherein the lid assembly comprises: a lid top having surface with a drink opening, a cutout defining a lid channel having a channel floor, and an outer periphery formed by a primary rim section having a cut-out, wherein the lid channel has a first channel sidewall and a second channel sidewall; a control assembly positioned in the lid channel and pivotable about a pivoting axis, said control assembly comprising a slider controller slidably positioned on an upper surface of a control arm and a slider follower positioned below a lower surface of the control arm; an actuator comprising a primary post in abutting contact with the control arm of the control assembly and a seal post having a drink opening seal pressed against an opening seat by a return spring to seal the drink opening; and wherein each of the first and second channel sidewalls of the lid channel comprises an upper edge and a lower edge that are angled between 10 degrees to 40 degrees relative to one another, and a receiving slot at an end of the upper and lower edges; wherein the control arm has a first side edge with a first pin and a second side edge with a second pin; and wherein the first pin is located in the receiving slot of the first channel sidewall and the second pin is located in the receiving slot of the second channel sidewall. The assembly for drinking can be a water bottle or a drinkware.

Example 61

The water bottle or drinkware, apparatus, assembly, and method of any of Examples 1-70 or any other embodiment described herein, wherein the slider controller is mechanically attached to the slider follower and movement of the slider controller directly moves the slider follower.

Example 62

The water bottle or drinkware, apparatus, assembly, and method of any of Examples 1-70 or any other embodiment described herein, wherein each receiving slot has a narrowed portion to form a socket at the receiving slot.

Example 63

An assembly for drinking comprising a lid assembly threaded attached to a container vessel, wherein the lid assembly comprises: a lid top having surface with a drink opening, a cutout defining a lid channel having a channel floor, and an outer periphery formed by a primary rim section having a cut-out, wherein the lid channel has a first channel sidewall and a second channel sidewall; a control assembly positioned in the lid channel and having a two pivot pins that are spaced from one another, said control assembly comprising a slider controller slidably positioned on an upper surface of a control arm and a slider follower positioned below a lower surface of the control arm; an actuator comprising a primary post in abutting contact with a curved bearing surface on the lower surface of the control arm of the control assembly and a seal post having a drink opening seal pressed against an opening seat by a return spring to seal the drink opening; and wherein the control assembly is pivotable only about a pivoting axis defined by the two pivot pins to exert a downward force on the primary post, which translates up and down in a direction parallel to a central vertical axis of the container vessel to separate the drink opening seal from the opening seat. The assembly for drinking can be a water bottle or a drinkware.

Example 64

The water bottle or drinkware, apparatus, assembly, and method of any of Examples 1-70 or any other embodiment described herein, wherein each of the first and second channel sidewalls of the lid channel comprises an upper edge and a lower edge that are angled between 10 degrees to 40 degrees relative to one another, and a receiving slot at an end of the upper and lower edges.

Example 65

The water bottle or drinkware, apparatus, assembly, and method of any of Examples 1-70 or any other embodiment described herein, wherein the two pivot pins include a first pivot pin and a second pivot pin, and wherein the control arm has a first side edge having the first pivot pin extending therefrom and a second side edge having the second pivot pin extending therefrom.

Example 66

The water bottle or drinkware, apparatus, assembly, and method of any of Examples 1-70 or any other embodiment described herein, wherein the first pivot pin is located in the receiving slot of the first channel sidewall and the second pivot pin is located in the receiving slot of the second channel sidewall.

Example 67

An assembly for drinking comprising a lid assembly threaded attached to a container vessel, wherein the lid assembly comprises: a lid top having surface with a drink opening, a cutout defining a lid channel having a channel floor, and an outer periphery formed by a primary rim section having a cut-out, wherein the lid channel has lid channel wall comprising a first channel sidewall, a second channel sidewall, and a channel floor; a control assembly positioned in the lid channel and having a two pivot pins that are spaced from one another, said control assembly comprising a slider controller, a control arm, and a slider follower that are mechanically together as a unit; an actuator comprising a primary post and a seal post connected by a bridge, said primary post in abutting contact with a lower surface of the control arm of the control assembly and a seal post having a drink opening seal pressed against an opening seat by a return spring to seal the drink opening; a guide shaped as a rib extending from the lid channel wall, said rib having a guide bottom edge; and wherein the bridge comprises a bridge channel and the rib is located in the bridge channel. The assembly for drinking can be a water bottle or a drinkware.

Example 68

The water bottle or drinkware, apparatus, assembly, and method of any of Examples 1-70 or any other embodiment described herein, wherein the actuator is rotatable about an axis defined by the primary post.

Example 69

The water bottle or drinkware, apparatus, assembly, and method of any of Examples 1-70 or any other embodiment described herein, wherein the actuator is rotatable to move the rib and the bridge channel out of alignment so that the rib is not located in the bridge channel.

Example 70

The water bottle or drinkware, apparatus, assembly, and method of any of Examples 1-70 or any other embodiment described herein, wherein the bridge channel is a through channel or has a bottom wall.

What is claimed is:

1. An assembly for drinking, said assembly comprising:
- a drinking vessel comprising a body having a central vertical axis, a threaded open top, and a closed bottom;
- a lid assembly threaded to the threaded open top of the drinking vessel, said lid assembly comprising:
  - a lid top having a surface with a cutout defining a lid channel having a channel floor and wherein the lid top is surrounded on an outer periphery by a primary rim section having a cut-out;
  - a control arm pivotably mounted in the lid channel of the lid top, the control arm having a rim piece located at the cut-out of the primary rim section and forming a rim portion at the control arm,
  - a slider controller located within two side edges of the control arm, the slider controller movable between a first position to lock pivotable motion of the control arm and movable to a second position to unlock pivotable motion of the control arm;
  - a clearance gap between a bottom of the control arm and a lid flange, the lid flange located below, elevation-wise, the surface of the lid top;
  - a well having a well surface with a drink opening and wherein the well surface is located below, elevation-wise, the surface of the lid top;
  - an actuator for opening and closing the drink opening, the actuator comprising a seal post having a drink opening seal mounted thereon and pressing against an opening seat in a seal closed position to close the drink opening, a primary post spaced from the seal post and projecting through a bore of a post support on the channel floor, and a bridge connecting the seal post and the primary post;
  - a return spring mounted around the post support and biasing against the channel floor and a retaining cap that is removably attached to the primary post;
  - wherein said return spring is in a first compressed state and biases the drink opening seal against the opening seat in the seal closed position when the control arm is in a rest position and not acted on by an external pivotable force; and
  - wherein said return spring is in a second compressed state when the control arm is pivoted by an external force to a pivoted position to move the primary post generally parallel to the central vertical axis, which moves the seal post generally parallel to the central vertical axis to move the drink opening seal away from the opening seat to open the drinking opening.

2. The assembly for drinking of claim 1, wherein the drinking vessel has a double wall structure with a gap therebetween.

3. The assembly for drinking of claim 1, wherein the slider controller first position is located further away from the drink opening than the slider controller second position.

4. The assembly for drinking of claim 3, further comprising a slider follower located below, elevation-wise, the control arm and the slider controller, the slider follower slidable by the slider controller.

5. The assembly for drinking of claim 1, wherein the lid channel comprises two spaced apart channel walls defining a channel width, and wherein each channel wall comprises a retaining slot comprising a rounded end.

6. The assembly for drinking of claim 5, wherein the control arm comprises two spaced apart pivot pins, and wherein each pivot pin is located in a respective retaining slot of the lid channel.

7. The assembly for drinking of claim 1, wherein control arm has a pull tab extending radially outwardly away from the central vertical axis.

8. The assembly for drinking of claim 7, wherein the control arm further comprises a curved end opposite the pull tab.

9. The assembly for drinking of claim 1, wherein the primary post is located atop a disc-shaped portion of the bridge.

10. The assembly for drinking of claim 9, wherein the primary post comprises a rounded free end and a notch adjacent to the disc-shaped portion.

11. The assembly for drinking of claim 1, wherein the bore of the post support limits movement of the primary post along a path that is generally parallel to the central vertical axis.

12. The assembly for drinking of claim 11, wherein the seal post moves along a path that is generally parallel to the central vertical axis.

13. The assembly for drinking of claim 1, wherein the bridge comprises a first bridge section connected to the seal post, a second bridge section connected to the primary post, and an intermediate bridge section that is angled to both the first bridge section and the second bridge section.

14. The assembly for drinking of claim 10, wherein the rounded free end of the primary post is pressed against a rounded bearing surface on the control arm.

15. The assembly for drinking of claim 1, wherein the post support has a first outside diameter section and a second outside diameter section that is smaller than the first outside diameter section, and wherein the bore of the post support passes through both the first and second outside diameter sections.

16. The assembly for drinking of claim 1, further comprising a post gasket secured to a bottom section of the primary post, and wherein the post gasket and the drink opening seal are pressed against surfaces of the lid top in the control arm rest position.

17. The assembly for drinking of claim 1, wherein the primary rim section occupies about 310 degrees to about 360 degrees of a circle.

18. An assembly for drinking, said assembly comprising:
- a drinking vessel comprising a body having a central vertical axis, a threaded open top, and a closed bottom;
- a lid assembly threaded to the threaded open top of the drinking vessel, said lid assembly comprising:
  - a lid top having a surface with a cutout defining a lid channel having a channel floor and wherein the lid top is surrounded on an outer periphery by a primary rim section having a cut-out;

a control arm pivotably mounted in the lid channel of the lid top, the control arm having a rim piece occupying the cut-out of the primary rim section and forming a rim portion that forms a ring with the primary rim section, a slider controller located within two side edges of the control arm, the slider controller movable between a first position to lock pivotable motion of the control arm and movable to a second position to unlock pivotable motion of the control arm;

a well having a well surface with a drink opening and an embankment;

an actuator for opening and closing the drink opening, the actuator comprising a seal post having a drink opening seal mounted thereon and pressing against an opening seat in a seal closed position to close the drink opening, a primary post spaced from the seal post and projecting through a bore of a post support on the channel floor, and a bridge connecting the seal post and the primary post; and a return spring mounted around the post support and biasing against the channel floor and a retaining cap that is removably attached to the primary post.

19. The assembly for drinking of claim 18, wherein the return spring is in a first compressed state and biases the drink opening seal against the opening seat in the seal closed position when the control arm is in a rest position and not acted on by an external pivotable force.

20. The assembly for drinking of claim 18, wherein the lid channel comprises two spaced apart channel walls defining a channel width, and wherein each channel wall comprises a retaining slot comprising a rounded end.

21. The assembly for drinking of claim 18, wherein the control arm has a pull tab extending radially outwardly away from the central vertical axis.

22. An assembly for drinking comprising a lid assembly threadedly attached to a container vessel, wherein the lid assembly comprises:

a lid top having a surface with a drink opening, a cutout defining a lid channel having a channel floor, and an outer periphery formed by a primary rim section having a cut-out, wherein the lid channel has lid channel wall comprising a first channel sidewall, a second channel sidewall, and a channel floor;

a control assembly positioned in the lid channel and having two pivot pins that are spaced from one another, said control assembly comprising a slider controller, a control arm, and a slider follower that are mechanically coupled together as a unit;

an actuator comprising a primary post and a seal post connected by a bridge, said primary post in abutting contact with a lower surface of the control arm of the control assembly and the seal post having a drink opening seal pressed against an opening seat by a return spring to seal the drink opening;

a guide having a rib extending from the lid channel wall, said rib having a guide bottom edge; and wherein the bridge comprises a bridge channel and the rib is located in the bridge channel.

23. The assembly for drinking of claim 22, wherein the actuator is rotatable about an axis defined by the primary post.

24. The assembly for drinking of claim 23, wherein the actuator is rotatable to move the rib and the bridge channel out of alignment so that the rib is not located in the bridge channel.

25. An assembly for drinking comprising a lid assembly threadedly attached to a container vessel comprising a body having a central vertical axis, wherein the lid assembly comprises:

a lid top having a surface with a drink opening, a cutout defining a lid channel having a channel floor, and an outer periphery formed by a primary rim section having a cut-out, wherein the lid channel has lid channel wall comprising a first channel sidewall, a second channel sidewall, and a channel floor;

a control assembly positioned in the lid channel for controlling flow through the drink opening, the control assembly comprising a control arm that is pivotable about a pivoting axis and a slider controller that is movable generally orthogonally to the central vertical axis to lock and unlock pivoting of the control arm;

an actuator that is movable by the control arm along a path that is generally parallel to the central vertical axis, the actuator comprising a primary post and a seal post connected by a bridge, said primary post contacts a lower surface of the control arm of the control assembly and the seal post has a drink opening seal pressed against an opening seat by a return spring to seal the drink opening in a rest position of the control arm, in which no external pivotable force is acted on the control arm;

wherein the control arm comprises a rim piece and a push tab; and wherein a retaining cap is attached to the primary post to compress the return spring inside the channel.

26. The assembly for drinking of claim 25, wherein the rim piece on the control arm is located at the cut-out of the primary rim section to form a ring with the primary rim section.

27. The assembly for drinking of claim 25, wherein the slider controller is located between two side edges of the control arm.

28. The assembly for drinking of claim 25, further comprising a slider follower located on a side of the control arm opposite the slider controller, and wherein the controller is mechanically coupled to the slider follower.

29. The assembly for drinking of claim 25, further comprising a guide having a rib extending from the lid channel wall and wherein the bridge comprises a bridge channel and the rib is located in the bridge channel.

30. The assembly for drinking of claim 25, further comprising a post gasket secured to a bottom section of the primary post, and wherein the post gasket and the drink opening seal are pressed against surfaces of the lid top in the rest position of the control arm.

31. The assembly for drinking of claim 25, wherein the control arm has a pair of pin ends, and wherein each pin end is located in a respective retaining slot of the lid channel.

32. The assembly for drinking of claim 25, wherein the control arm has a rounded bearing surface, and wherein the primary post contacts the rounded bearing surface.

33. The assembly for drinking of claim 25, further comprising a post support projecting above the channel floor, and wherein the return spring is located around the post support.

* * * * *